US006510307B2

(12) United States Patent
Sato et al.

(10) Patent No.: US 6,510,307 B2
(45) Date of Patent: Jan. 21, 2003

(54) TRANSFER DEVICE, IMAGE-FORMING APPARATUS USING THE SAME AND METHOD FOR PRODUCING TRANSFERRING MEMBER

(75) Inventors: Masahiro Sato, Saitama (JP); Toshihiko Mitsuhashi, Saitama (JP); Yusuke Kitagawa, Saitama (JP); Kazuya Yamanoi, Saitama (JP); Ryuichi Yamamoto, Saitama (JP); Hiroyuki Okawa, Saitama (JP); Koji Miyake, Saitama (JP); Koichi Matsumoto, Kanagawa (JP); Takeshi Kawai, Kanagawa (JP); Shoichi Morita, Kanagawa (JP); Toshio Masubuchi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/944,100

(22) Filed: Sep. 4, 2001

(65) Prior Publication Data

US 2002/0102115 A1 Aug. 1, 2002

(30) Foreign Application Priority Data

Dec. 18, 2000 (JP) ..... 2000-384222

(51) Int. Cl.[7] ..... G03G 15/16
(52) U.S. Cl. ..... 399/313
(58) Field of Search ..... 399/297, 313, 399/314; 430/126

(56) References Cited

U.S. PATENT DOCUMENTS 5,669,053 A * 9/1997 Hashizume et al. ..... 399/313

FOREIGN PATENT DOCUMENTS

| | | |
|---|---|---|
| JP | 3-202885 | 9/1991 |
| JP | 6-324583 | 11/1994 |
| JP | 7-168401 | 7/1995 |
| JP | 2000-278014 | 10/2000 |

* cited by examiner

*Primary Examiner*—Hoang Ngo
(74) *Attorney, Agent, or Firm*—Morgan, Lewis & Bockius LLP

(57) ABSTRACT

A transfer device for transferring an image on an image carrier 1 to a recording material 2, the transfer device includes a transferring member 4 adapted to nip and convey the recording material 2 between the transferring member 4 and the image carrier 1, a guard resin layer 5 having a surface microhardness not smaller than surface microhardness corresponding to polyimide, the guard resin layer 5 provided on a surface of the transferring member 4, and an adjustment resistance layer 6 provided as a ground layer of the guard resin layer 5, the adjustment resistance layer 6 adapted to inhibit an accumulation of charge in the guard resin layer 5. Or, the guard resin layer 5 made of an epoxy resin is provided on the surface of the transferring member 4, the adjustment resistance layer 6 having a smooth interface with the guard resin layer 5, the adjustment resistance layer 6 adapted to inhibit accumulation of charge in the guard resin layer. Furthermore, a scraper 8 for cleaning is provided on the surface of the transferring member 4 so as to contact with the surface of the transferring member. An image-forming apparatus is constructed by using the transferring device.

41 Claims, 17 Drawing Sheets

FIG. 18

| MODULAS ($kg/mm^2$) | | BTR SURFACE ROUGHNESS (Rz/μm) | CLEANING PROPERTIES |
|---|---|---|---|
| ADJUSTMENT RESISTANCE LAYER | GUARD RESIN LAYER (PI LAYER) | | |
| 50 | 200 | < 1.0 | NO PROBLEM |
| 100 | 200 | < 1.0 | NO PROBLEM |
| 200 | 200 | 2.0 | IMPERFECT CLEANING OCCURS |
| 200 | 300 | < 1.0 | NO PROBLEM |
| 50 | 400 | < 1.0 | NO PROBLEM |
| 100 | 400 | < 1.0 | NO PROBLEM |

TRANSFER DEVICE, IMAGE-FORMING APPARATUS USING THE SAME AND METHOD FOR PRODUCING TRANSFERRING MEMBER

BACKGROUND OF THE INVENTION

1. Field of the Invention

The present invention relates to a transfer device for transferring an image on an image carrier to a recording material. More particularly, the present invention relates to improvements in a transfer device comprising a transferring member for transferring a recording material through a nip between the image carrier and the transferring member, an image-forming apparatus using the transferring member and method for producing the transferring member.

2. Description of the Related Art

By way of example, a conventional image-forming apparatus has been already provided in a form which operates in an electrophotographic process comprising the steps of forming an electrostatic latent image on an image carrier (which widely includes a latent image carrier such as photoreceptor drum, a combination of latent image carrier and intermediate transfer drum for intermediately transferring and retaining an image on the latent image carrier), developing the electrostatic latent image with a predetermined toner by a developing device, and then transferring the toner image formed on the image carrier onto a recording material via a transfer device.

As such a transfer device there has been known a non-contact type transfer device such as corotoron. This non-contact type transfer device is disadvantageous in that it causes troubles with generation of ozone. The recent trend is for more so-called contact type transfer device to be used which transfers a toner image on the image carrier to a recording material in a contact process while conveying the recording material through a nip between a transfer roll disposed in contact with or in the vicinity of the image carrier and the image carrier.

For this contact type transfer device, there has been often used a transfer roll comprising a metallic roll coated with a fluorinated rubber layer.

In order to effectively prevent troubles such as attachment of residual toners to this type of transfer roll, a cleaning device comprising a cleaning blade disposed in contact with the transfer roll is provided.

Such a cleaning blade may be made of an elastic material such as urethane rubber to prevent damage on the fluorinated layer which is a surface coat layer on the transfer roll.

In this type of transfer device, the frictional resistance of the cleaning blade with the surface of the transfer roll can be suppressed to a relatively small value due to the surface treatment of the transfer roll. However, this type transfer device is technically disadvantageous in that as the recording material runs, more external additives for toner are attached to the surface of the transfer roll, raising the coefficient of friction of the cleaning blade with the surface of the transfer roll and hence giving more rotary load to the transfer roll. Thus, the surface of the transfer roll cannot be cleaned at a low torque.

As a result, a high rotary torque is needed to rotate the transfer roll in a stable manner. This accordingly raises the cost of driving source to disadvantage.

In order to accurately control the density of an image transferred onto the recording material, a density control process which controls image density has been already proposed, e.g., by forming a density patch for density control on an image carrier, transferring the density patch to the surface of a transfer roll, and then detecting the density whereby the density corresponding to an image transferred to the recording material can be directly detected (see JP-A-7-168401 (The term "JP-A" as used herein means an "unexamined published Japanese patent application")).

However, the foregoing transfer device has a transfer roll comprising a surface rubber layer coated with a fluorinated layer and thus can hardly give specular reflection as a surface optical property. For example, even if a density patch is formed on the surface of the transfer roll, the density of the density patch can hardly be optically detected.

This density control process is also technically disadvantageous in that even if the density patch transferred to the transfer roll can be removed by the cleaning blade, residual toner gradually stains the surface of the transfer roll, the reflectance of the surface of the transfer roll is lowered, and hence the detection of density patch is inaccurate performed.

In particular, when the toner used comprises substantially spherical particles, it is more likely that the toner can pass through the cleaning blade to make the foregoing technical problems remarkable.

As a method for cleaning the surface of a hard and smooth transfer roll, there has been proposed that a metallic scraper is effective (as in JP-A-6-324583). However, there is no further specific disclosure relating to the transfer roll.

On the other hand, as a prior art of a transfer roll, there has been proposed a transfer roll comprising a first layer made of an elastic material and a second layer made of a resin having a higher resistance than that of the first layer (as in JP-A-3-202885). As the second layer (a surface layer), there has been disclosed one comprising a polycarbonate, polyester, nylon or the like as a base.

There is an apprehension that when the foregoing metallic scraper is applied to the transfer roll having such a constitution, the surface layer of the transfer roll is scratched or abraded in a short period of time to cause imperfect cleaning or defective detection of density patch.

In order to solve these technical problems, the present applicant proposed a transfer device provided with a transfer member (e.g., transfer roll) having a polyimide resin layer formed on the surface thereof (Japanese Patent Application No. 2000-278014).

In accordance with this type of transfer device, the constitution of a hard transfer roll having a metallic roll with a polyimide resin layer provided thereon makes it possible to eliminate the apprehension of scratching or abrasion even if the metallic scraper comes in contact with the transfer roll because the polyimide resin layer has a high mechanical strength.

In this transfer roll having a polyimide resin layer formed on the surface thereof, the polyimide resin layer is provided with some electrical conductivity to assure desired transferring properties. However, in view of manufacturing cost, the polyimide resin layer is thin. Thus, the resistance of the polyimide resin layer must be set to a somewhat high value to prevent the leakage of current between the metallic roll and the image carrier.

As a result, charge can be easily accumulated in the polyimide resin layer. Thus, there is an apprehension that when transfer is conducted in a high electric field as in printing on OHP sheet or cardboard or double-sided printing, a sufficient transfer electric field cannot be obtained, causing imperfect transfer.

Even if an epoxy resin layer having a high abrasion resistance is provided on the surface of the metallic roll instead of polyimide resin layer, there is an apprehension that the accumulation of charge causes imperfect transfer as in the case of polyimide resin layer because the epoxy resin layer has an extremely high resistance, although the cleaning properties of the metallic scraper may be kept good.

SUMMARY OF THE INVENTION

The present invention has been worked out to solve the foregoing technical problems. An object of the present invention is to provide a transfer device which can be cleaned at a low torque while maintaining good transferring properties and, when a method is employed which forms a process control image such as a density control patch on a transferring member, the transfer device can certainly accomplish the detection of process image, an image-forming apparatus using the transfer device, and method for producing the transferring member.

In other words, as shown in FIGS. 1A and 1B, according to the present invention, there is provided a transfer device for transferring an image on an image carrier 1 to a recording material 2, the transfer device comprising a transferring member 4 adapted to nip and convey the recording material 2 between the transferring member 4 and the image carrier 1, a guard resin layer 5 having a surface microhardness of not smaller than 18 as measured under a test load of 2.0 gf (19.6 mN) and a load rate of 0.0145 gf (0.1421 mN)/sec by a Type DUH-201S dynamic ultramicrohardness meter produced by Shimadzu Corp. with a triangular pyramid indenter having 115° in a ridge angle, the guard resin layer provided on a surface of the transferring member, and an adjustment resistance layer 6 provided as a ground layer of the guard resin layer 5, the adjustment resistance layer 6 adapted to inhibit an accumulation of charge in the guard resin layer.

In this technical means, the image carrier 1 widely includes an image-forming carrier such as latent image carrier and an intermediate transfer material for intermediately retaining an image from this image-forming carrier so long as these carry an image.

The transferring member 4 is not limited to a roll but may be in a form of a belt so long as the transferring member 4 nips and conveys the recording material 2 between the transferring member 4 and the image carrier 1.

Furthermore, the transferring member 4 comprise a guard resin layer 5 on a surface thereof and an adjustment resistance layer 6 as a ground layer of the guard resin layer 5. For example, when the transferring member 4 is in the form of the roll, the transferring member 4 may often comprise a metallic core 7 for securing enough rigidity for nipping and conveying between the image carrier 1 and the transferring member 4 and a guard resin layer 5 provided on periphery of the core 7 with an adjustment resistance layer 6 interposed therebetween.

There is an apprehensiveness that the transferring member 4 may be subject to attachment of image-forming particles such as toner or external additives to the surface thereof. In order to clean the surface of the transferring member 4, a cleaning scraper 8 is normally provided so as to contact with the guard resin layer 5 on the transferring member 4.

The guard resin layer 5 has surface microhardness of not smaller than surface microhardness corresponding to a polyimide resin.

The term "surface microhardness" as used herein is meant to indicate microhardness of a surface portion of the guard resin layer 5 rather than total hardness of the guard resin layer 5 and the adjustment resistance layer 6. Paying attention to the fact that grinding has an effect on the microhardness of the surface portion of the guard resin layer, the polyimide resin which has the highest microhardness as affiars stand is took for a comparative standard, and a material having a microhardness of not smaller than that of polyimide resin is considered practically acceptable.

Measurement of the microhardness can be accomplished by method defined in JIS. Alternatively, other methods independently determined with existing surface microhardness meters may be properly employed. Accordingly, any surface microhardness meter can be used so long as the guard resin layer has a surface microhardness not smaller than that of polyimide resin regardless.

Generall, measurement principle of the surface mircrohardness is shown in FIG. 1B. A needle penetrator 9 having a predetermined shape is pressed against the surface of the guard resin layer 5 to a predetermined load P (mN). Supposing that the penetration depth of the penetrator 9 is D ($\mu$m), the surface microhardness of the guard resin layer is the greater, D is the smaller. The surface microhardness DH is represented by, e.g., the following equation:

$$DH=\alpha \cdot P/D$$

where $\alpha$ is a coefficient predetermined by shape of the penetrator 9 and measurement conditions.

An example is shown in which surface microhardness is predetermined by specific hardness meter. The surface microhardness of the guard resin layer 5 is not smaller than 18 as measured under a test load of 2.0 gf (19.6 mN) and a load rate of 0.0145 gf (0.1421 mN)/sec by a Type DUH-201S dynamic ultramicrohardness meter produced by Shimadzu Corp. with a triangular pyramid penetrator having a ridge angle of 115°.

The term "surface microhardness of not smaller than 18" as used herein is meant to indicate that since the surface microhardness of polyimide resin is in a range of 18 to 50 as measured under the same conditions as mentioned above, the lower limit is used.

The guard resin layer 5 preferably has contact angle of not smaller than 70° with respect to water.

The contact angle with respect to water is determined by surface energy and surface shape (roughness) of the material. When the guard resin layer 5 has a contact angle of not smaller than 70° with respect to water, the guard resin layer 5 is hardly attract image-forming particles and external additives and is easily cleaned with the scraper 8 to advantage.

In general, a polyimide resin has an initial contact angle in a range of 70° to 80° and shows a contact angle drop in a range of about 5° to 10° after abrasion.

Thickness of the guard resin layer 5 is properly predetermined, and is normally in a range of 10 $\mu$m to 100 $\mu$m.

When the thickness of the guard resin layer 5 falls below 10 $\mu$m, the guard resin layer 5 is subject to problem on strength during producing process and cleaning process. On the contrary, when the thickness of the guard resin layer 5 exceeds 100 $\mu$m, the guard resin layer 5 is disadvantageous in producibility, cost and transferring properties.

It is preferred that the guard resin layer 5 is hardly deformed when brought into contact with the scraper 8. Thus, the guard resin layer 5 preferably has a Young's modulus of not smaller than 200 kg/mm$^2$.

When the Young's modulus of the guard resin layer 5 is too small, since an outer diameter thereof is changed or unevenness of the adjustment resistance layer 6 is appeared on the surface of the guard resin layer 5, the cleaning properties of the scraper 8 is impaired.

In general, a polyimide resin has a Young's modulus of 200 kg/mm$^2$ at minimum and normally not smaller than 400 kg/mm$^2$.

In order to keep transferring properties of the transferring member 5 more fairly, the guard resin layer 5 preferably has an electrically-conductive material (e.g., resistance-adjusting material such as carbon) dispersed therein.

This is because the dispersion of the electrically-conductive material makes it possible to easily accomplish the adjustment of resistance of the guard resin layer 5.

As the electrically-conductive material to be dispersed in the guard resin layer 5, there may be properly selected from the group consisting of electronically-conductive material such as carbon black and metal oxide and ionically-conductive material such as quaternary ammonium salt. In practice, however, the electronically-conductive material is preferred because it has little environmental dependence.

In order to further enhance the resistance retention or uniformity of the guard resin layer 5, it is preferred that an electrically-conductive polymer material be used as an electrically-conductive material.

With respect to the surface properties of the transferring member 4, that is, the surface properties of the guard resin layer 5, in order to maintain the cleaning properties by the scraper 8, it is preferred that surface roughness of the transferring member 4 is not greater than the minimum diameter of the image-forming particles.

According to this arrangement, a phenomenon can be avoided that the image-forming particles are caught by indentation on the surface of the transferring member 4.

The adjustment resistance layer 6 may be properly selected so far as the adjustment resistance layer 6 can inhibit the accumulation of charge on the guard resin layer 5 to keep the transferring properties good. In practice, however, the adjustment resistance layer 6 preferably has elasticity so that a nip region having a predetermined width is formed between the transferring member 4 and the image carrier 1.

In accordance with this embodiment, a wide nip region can be secured without raising nip pressure between the transferring member 4 and the image carrier 1.

In relation to preferred embodiment of elasticity, the adjustment resistance layer 6 preferably has an Asker C hardness of not smaller than 20.

Since a sufficient tension is obtained between the guard resin layer 5 and the adjustment resistance layer 6, it is preferred to use a tubular polyimide resin as mentioned later as the guard resin layer 5.

In a preferred embodiment of the adjustment resistance layer 6 for preventing the accumulation of charge on the guard resin layer 5, the adjustment resistance layer 6 has a resistance in a range of $10^6\Omega$ to $10^9\Omega$ when 1,000 V is applied thereto and the guard resin layer 5 has a lower resistance than resistance of the adjustment resistance layer 6.

With regard to relationship between the guard resin layer 5 and the adjustment resistance layer 6, in view of keeping the cleaning properties good, it is preferred that the modulus of the guard resin layer 5 is greater than that of the adjustment resistance layer 6.

When the modulus of the guard resin layer 5 is not greater than that of the adjustment resistance layer 6, unevenness on the adjustment resistance layer 6, which is a ground layer, appears on the surface of the tubular guard resin layer 5 so that there is an apprehension to adversely affect the cleaning properties. On the contrary, when the modulus of the guard resin layer 5 is greater than that of the adjustment resistance layer 6, the adverse effect on the cleaning properties can be effectively avoided.

The constitution of the transferring member 4 is accomplished by any known method.

For example, the guard resin layer 5 may be formed by any known coating method such as flow coating and dipping. Alternatively, a tube or the like may be used as the guard resin layer 5. No matter whatever method is used, it is preferred that uniform flatness is secured.

A typical embodiment of the transferring member 4 is a transferring member provided with a tubular guard resin layer 5.

The foregoing embodiment of the transferring member 4 is prepared by a process which comprises the steps of preparing an inner structure having an adjustment resistance layer 6 provided on periphery of a base member such as core 7, and inserting the inner structure into a tube serving as a guard resin layer 5.

Then, in order to accomplish preferred state between the produced tubular guard resin layer 5 and the inner structure, it is necessary that the tube serving as the guard resin layer 5 closely adheres to periphery of the inner structure.

In this producing method, there are a method of assisting the insertion by air and else to easily realize the insertion process into the tube serving as the guard resin layer 5. For example, after cooling the inner structure at a low temperature, the inner structure is inserted into the tube serving as the guard resin layer 5.

In order to keep a adhesion between the produced inner structure and the tube serving as the guard resin layer 5 good, it is necessary that the inner structure is expanded under preferred condition during the insertion process into the tube serving as the guard resin layer 5.

As the expansion conditions, the inner structure comprises the adjustment resistance layer 6 having a linear expansion coefficient so that an outer diameter of the inner structure at a time when the inner structure is cooled is smaller than an inner diameter of the tube serving as the guard resin layer at normal temperature and the outer diameter of the inner structure at normal temperature is greater than the inner diameter of the tube at normal temperature.

The material of the scraper 8 is not limited to metal. The material of the scraper includes a high hardness resin which can clean at low torque. However, the scraper 8 is preferably made of metal in view of cost.

The metal constituting the metallic scraper 8 is properly selected from SUS, phosphor bronze, and the like.

In this embodiment, the metallic scraper 8 comes in linear contact with the surface of the transferring member 4. Thus, the frictional resistance of the metallic scraper 8 with the surface of the transferring member 4 can be suppressed to an extremely small value to enable to clean the surface of the transferring member 4 at low torque.

With regard to the method for producing the metallic scraper 8, etching is preferable because the etching generates no burr on an edge of the product.

In order to further reduce the load of the metallic scraper 8 on the transferring member 4, the metallic scraper 8 is preferably coated with a low friction coat layer at least on the surface thereof contacting with the transferring member 4.

In order to prevent the metallic scraper 8 and the transferring member 4 from being caught by each other, the metallic scraper 8 is preferably formed to curve at an end in a longitudinal direction of the metallic scraper 8, the end contacts with the transferring member 4.

In using of the metallic scraper 8, it is necessary that leakage of transfer current through the metallic scraper 8 is prevented.

In this case, the metallic scraper 8 is supported so as not to connect to the ground.

The term "being supported so as not to connect to the ground" as used herein is meant to indicate that the metallic scraper 8 is supported and insulated from the ground or supported under application of the same voltage as that applied to the transferring member 4. In this arrangement, imperfect transfer due to leakage of transfer current is prevented.

In another embodiment the present invention, as shown in FIG. 1A, there may be provided a transfer device for transferring an image on an image carrier 1 to a recording material 2, comprising a transferring member 4 adapted to nip and convey the recording material 2 between the transferring member 4 and the image carrier 1, a guard resin layer 5 made of an epoxy resin, provided on a surface of the transferring member 4, and an adjustment resistance layer 6 provided as a ground layer of the guard resin layer 5, the adjustment resistance layer 6 having a smooth interface with the guard resin layer 5, the adjustment resistance layer 6 adapted to inhibit accumulation of charge in the guard resin layer 5.

In this embodiment, the requirement for "smooth interface with the guard resin layer 5" is based on the fact that if the adjustment resistance layer 6 has a rough surface, the surface of the guard resin layer 5 made of, e.g., epoxy resin cannot be rendered smooth to affect the transfer properties.

Of course, the embodiment of the transferring member 4 (including provision of the guard resin layer 5 with electrical conductivity and surface roughness of the transferring member 4) and the cleaning scraper 8 to be disposed in contact with the transferring member 4 can be properly selected as mentioned above.

In order to reduce frictional force of the guard resin layer 5 with, e.g., the scraper 8 in this technical means, the guard resin layer 5 made of an epoxy resin includes a fluororesin incorporated therein.

In order to effectively prevent the scraper 8 from being caught by indentations formed on an area of the transferring member 4 in contact with the scraper 8, the adjustment resistance layer 6 preferably has an Asker C hardness of not smaller than 70.

In an embodiment using the guard resin layer 5 made of the epoxy resin, in order to act the adjustment resistance layer 6, it is necessary that the adjustment resistance layer 6 is formed by a material having a low resistance than resistance of the guard resin layer 5 made of the epoxy resin.

Thus, the guard resin layer 5 has the surface microhardness of not smaller than the surface microhardness corresponding to the polyimide resin or is formed of the epoxy resin having the high abrasion resistance to enable to use the metallic scraper 8 or the like as a cleaning element and accomplish cleaning at low torque.

Further, the guard resin layer 5 which is the surface of the transferring member 4 is formed by, e.g., the polyimide resin or the epoxy resin, to render the surface layer of the transferring member 4 smooth and highly reflective.

The smoothness or reflectivity of the surface layer is normally determined during producing process of the polyimide resin or the epoxy resin. Of course, any proper post-treatment such as polishing may be conducted.

In such transfer device, a density patch or the like for density control can be formed on the transferring member 4 whereby information such as image density can be detected.

The present invention can be applied not only to the foregoing transfer device but also to an image-forming apparatus comprising this transfer device.

In this case, as shown in FIG. 1A, there is provided an image-forming device comprising an image carrier 1 adapted to carry an image, and a transfer device 3 adapted to transfer the image on the image carrier 1 to a recording material 2, wherein the transfer device 3 comprises a transferring member 4 adapted to nip and convey the recording material 2 between the transferring member 4 and the image carrier 1, a guard resin layer 5 having surface microhardness not smaller than surface microhardness corresponding to polyimide, the guard resin layer 5 provided on a surface of the transferring member 4, and an adjustment resistance layer 6 provided as a ground layer of the guard resin layer 5, the adjustment resistance layer 6 adapted to inhibit an accumulation of charge in the guard resin layer 5, or wherein the transfer device 3 comprises the guard resin layer 5 made of an epoxy resin, provided on a surface of the transferring member 4, and the adjustment resistance layer 6 provided as a ground layer of the guard resin layer 5, the adjustment resistance layer 6 having a smooth interface with the guard resin layer 5, the adjustment resistance layer 6 adapted to inhibit accumulation of charge in the guard resin layer. Furthermore, in addition to the above described, the guard resin layer 6 on the transferring member 4 is provided with a scraper 8 for cleaning to contact with the guard resin layer 6.

In order to realize production of an image with high quality, this image-forming apparatus may further comprises a process controlling unit adapted to control the image to be formed by forming a process control image (e.g., density patch for density control) on the transferring member 4 and detecting information of the process control image.

From another standpoint of view, in order to realize production of an image with high quality, it is preferred that spherical particles having shape coefficient of not greater than 130 is used as image-forming particles to be formed on the image carrier 1 to assure a high transferability.

Figure 4A:
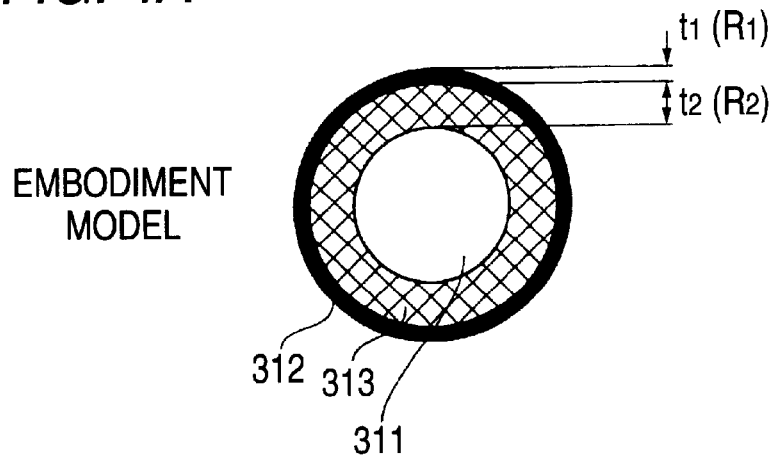
FIG. 4A is an explanatory view illustrating an example of structure of a transfer roll used in the first embodiment (an embodiment of the invention).
Figure 4B:
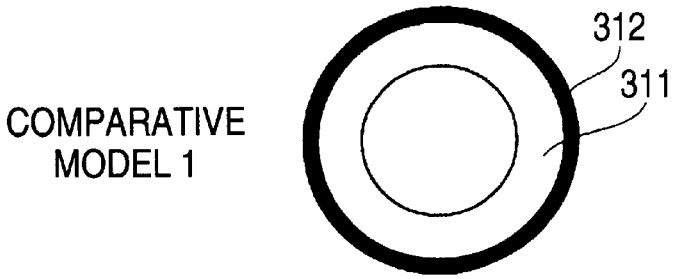
Figure 4C:
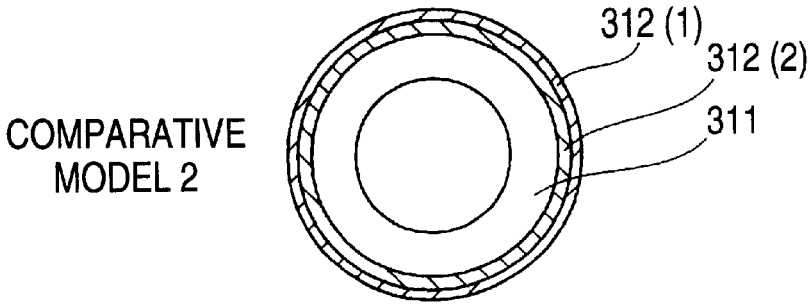

Each of FIGS. 4B and 4C is an explanatory view illustrating an example of the structure of a transfer roll according to a comparative model (comparative models 1, 2).

Figure 5:
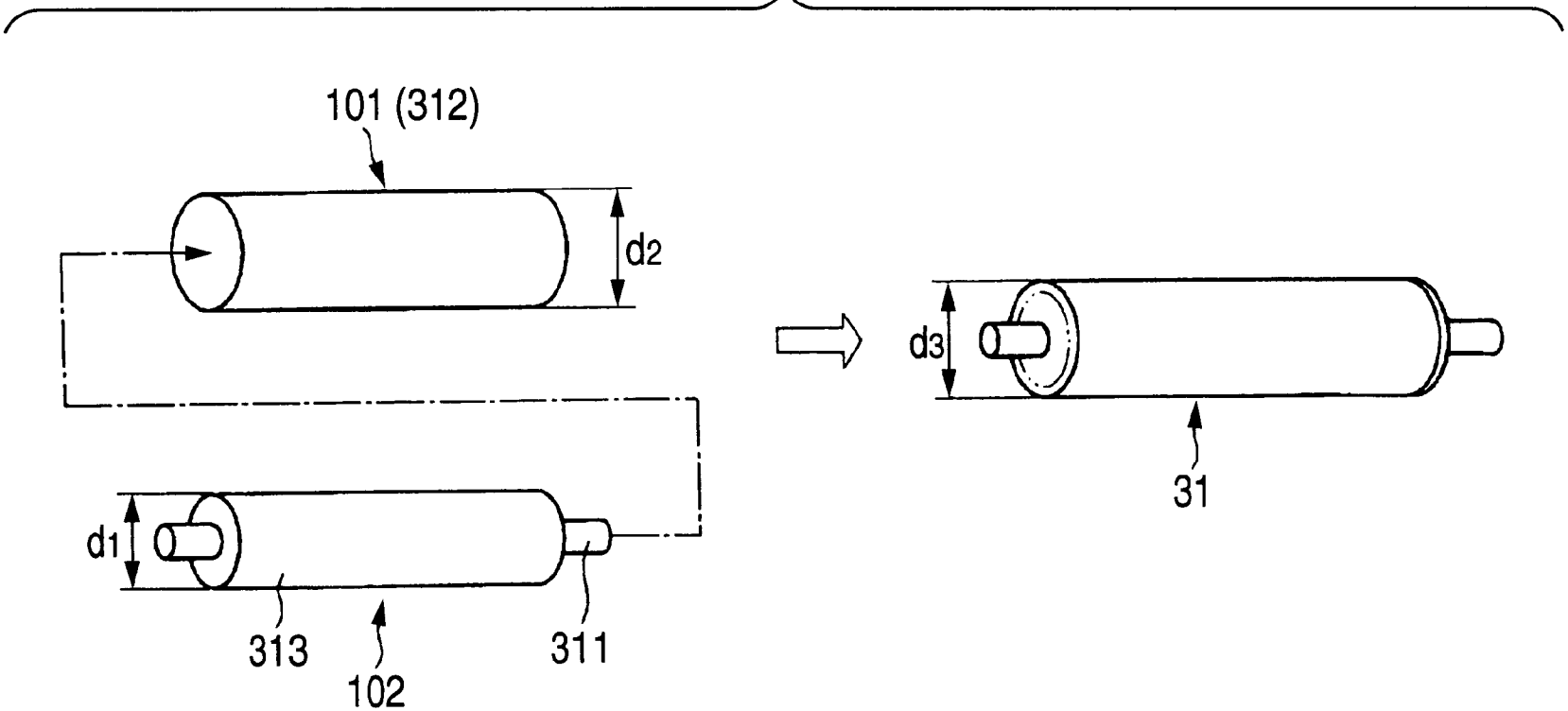

FIG. 5 is an explanatory view illustrating method for producing a transfer roll used in the first embodiment.

Figure 6:
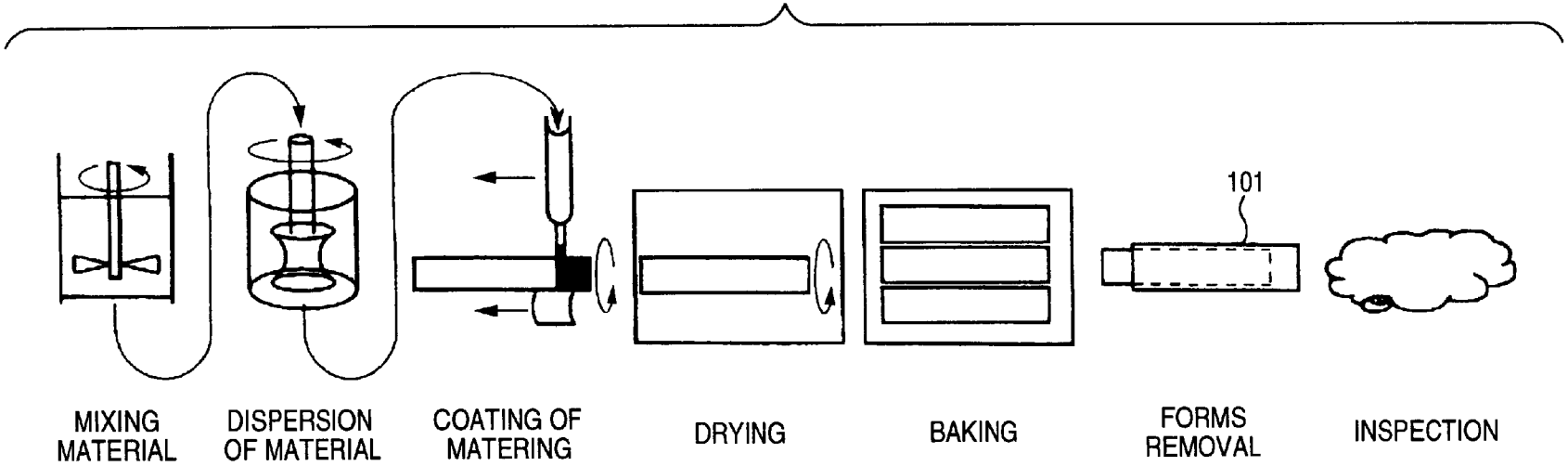

FIG. 6 is an explanatory view illustrating method for producing a tube, which acts as a guard resin layer, used in the first embodiment.

Figure 7:
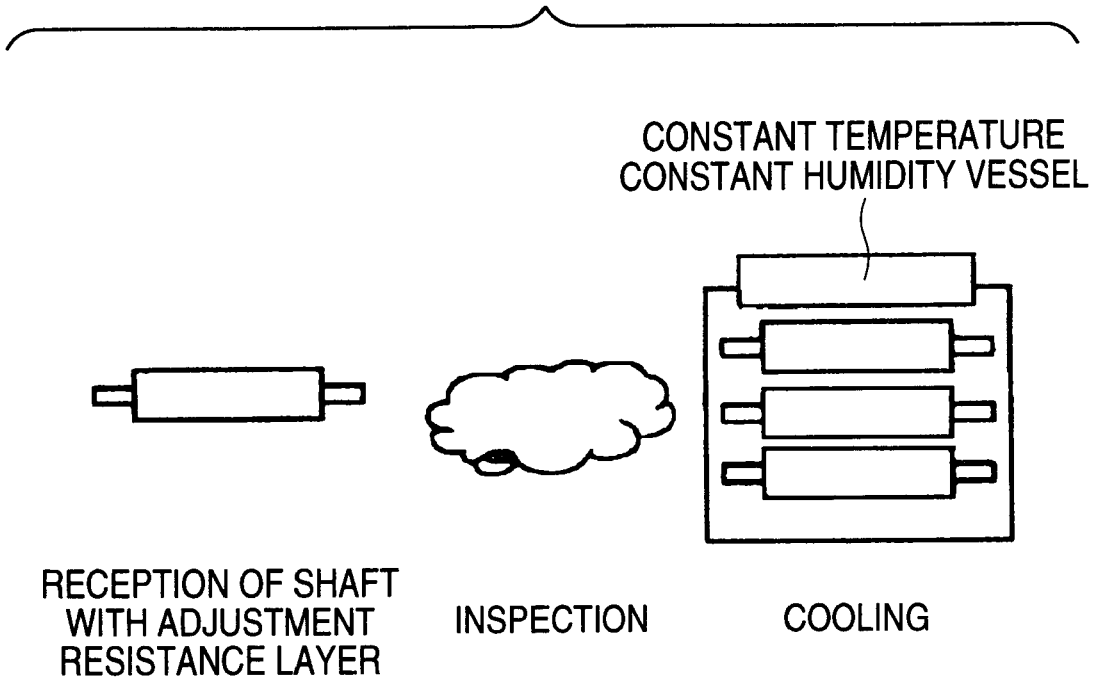

FIG. 7 is an explanatory view illustrating method for producing an inner structure used in the first embodiment.

Figure 3:
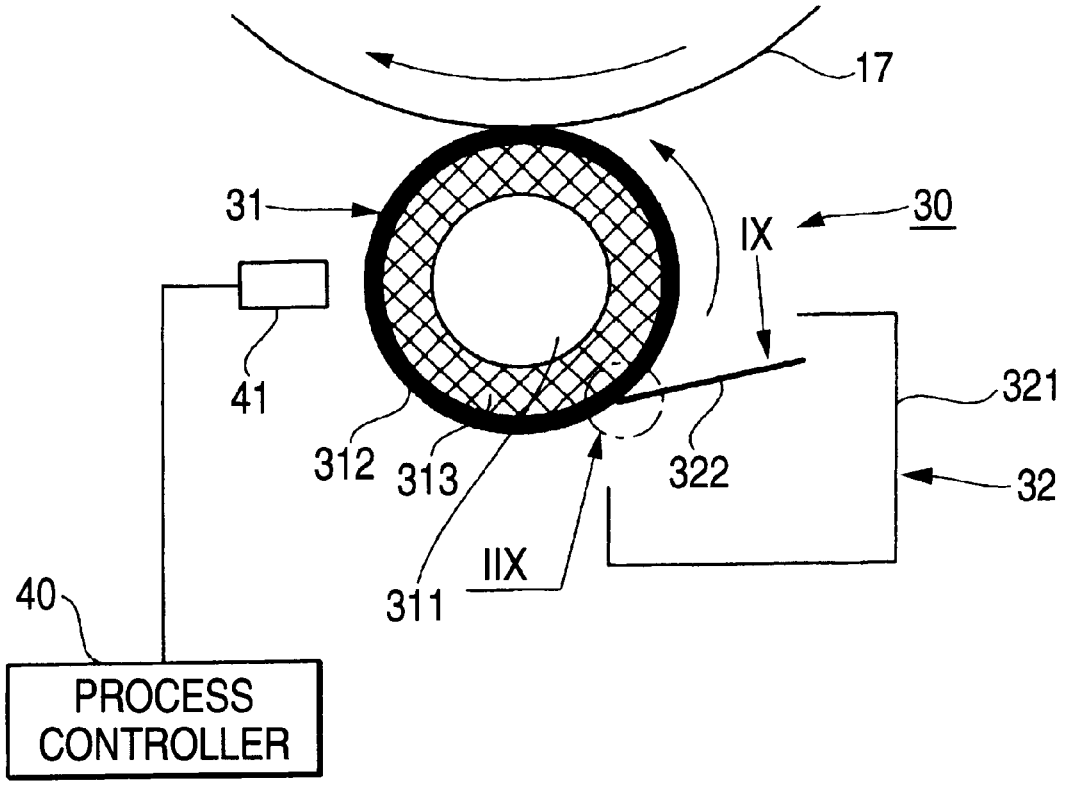
FIG. 3 is an explanatory view illustrating details of a transfer device to be used in the first embodiment.
Figure 8A:
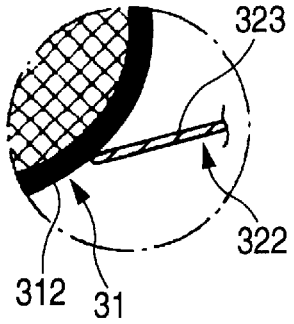

FIG. 8A is a detail view of a IIX portion of FIG. 3.

Figure 8B:
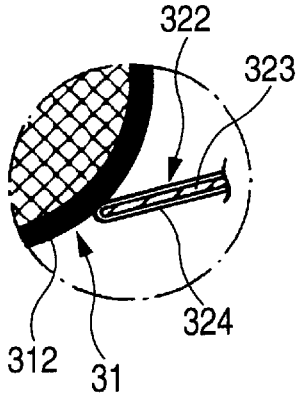

FIG. 8B is an explanatory view illustrating a variation of FIG. 8A.

Figure 9:
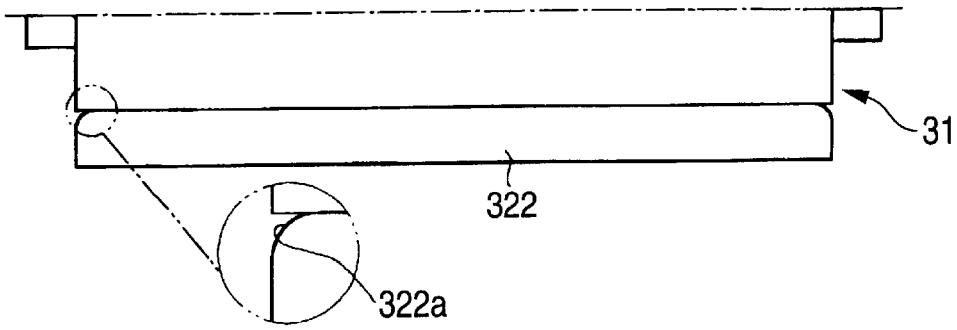

FIG. 9 is a diagram viewed in a direction indicated by the arrow IV in FIG. 3.

Figure 10:
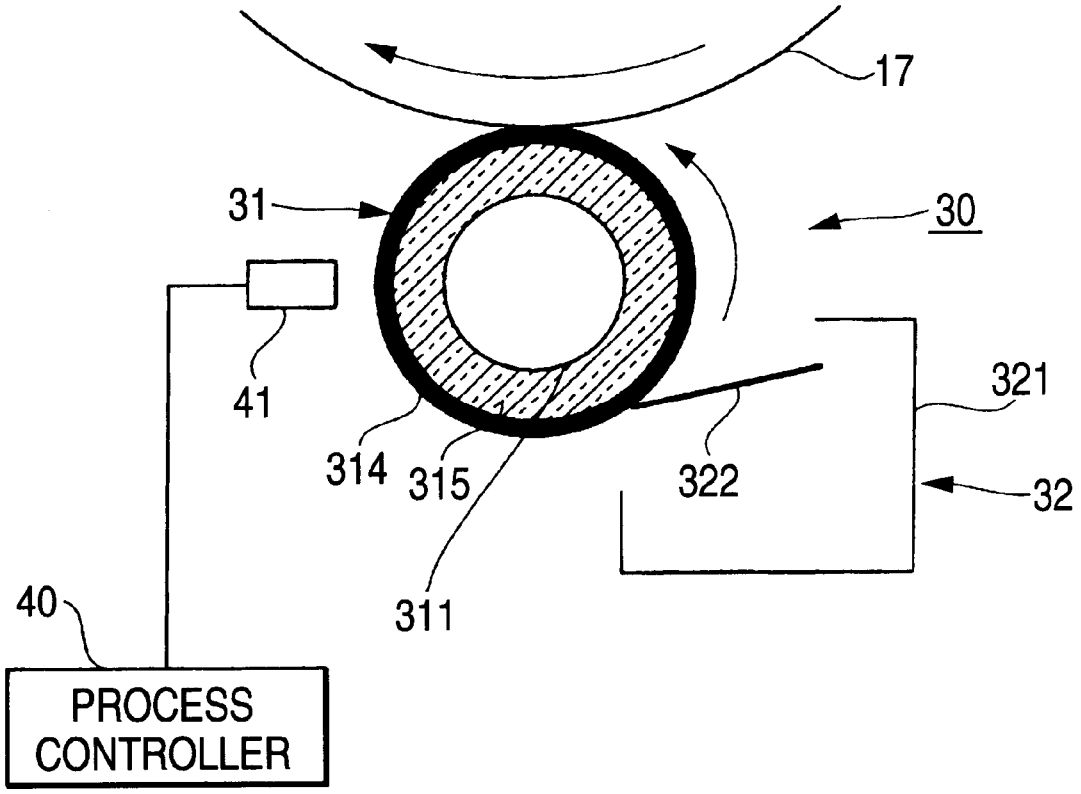

FIG. 10 is an explanatory view illustrating an essential part of an image-forming apparatus according to the second embodiment.

Figure 11A:
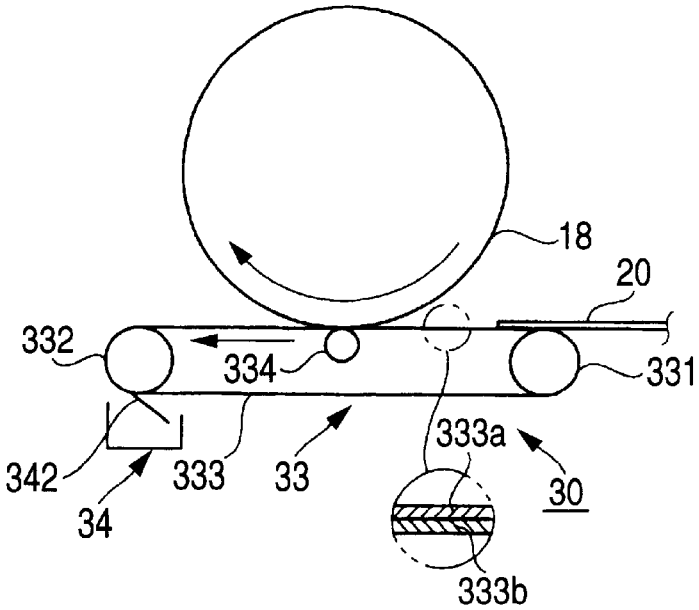

FIG. 11A is an explanatory view illustrating an essential part of an image-forming apparatus according to the third embodiment.

Figure 11B:
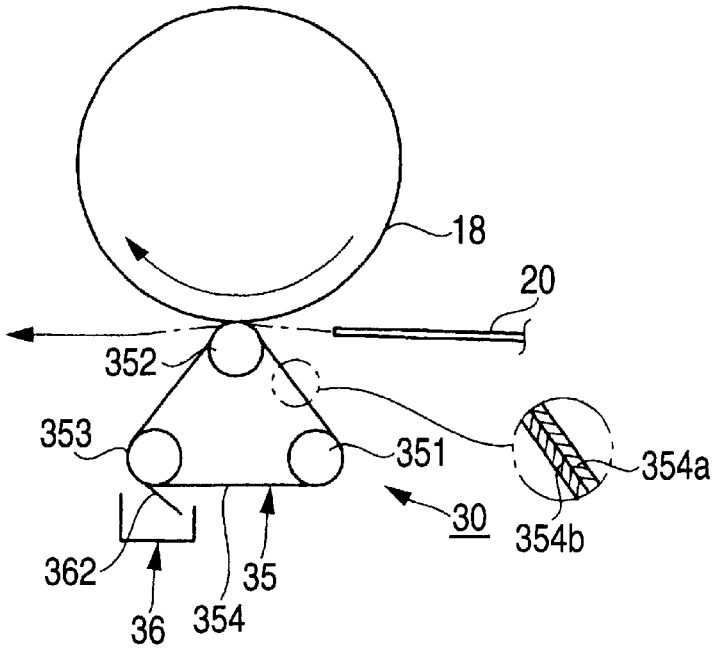

FIG. 11B is an explanatory view illustrating a variation of FIG. 11A.

Figure 12:
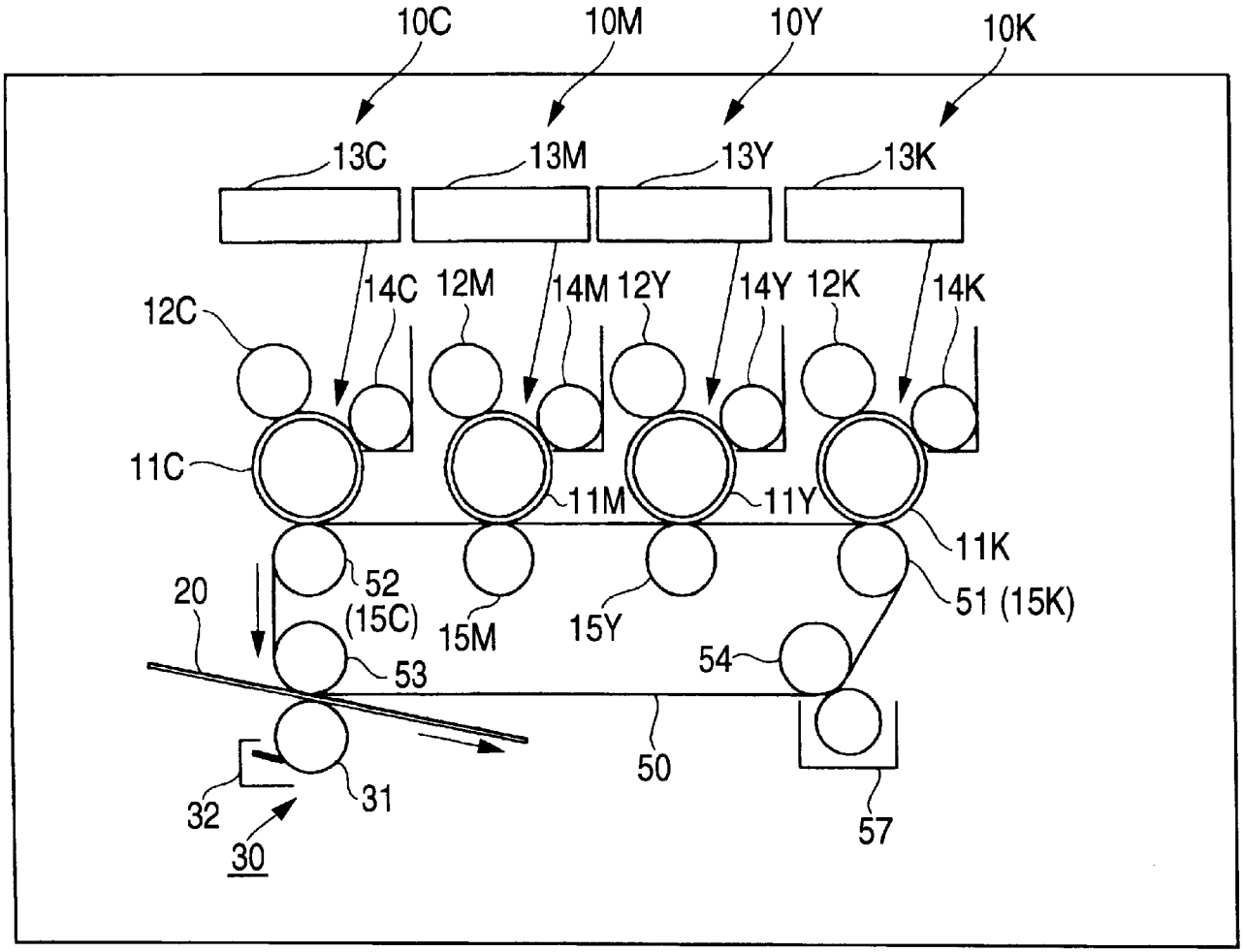

FIG. 12 is an explanatory view illustrating the entire structure of an image-forming apparatus according to the fourth embodiment.

Figure 13:
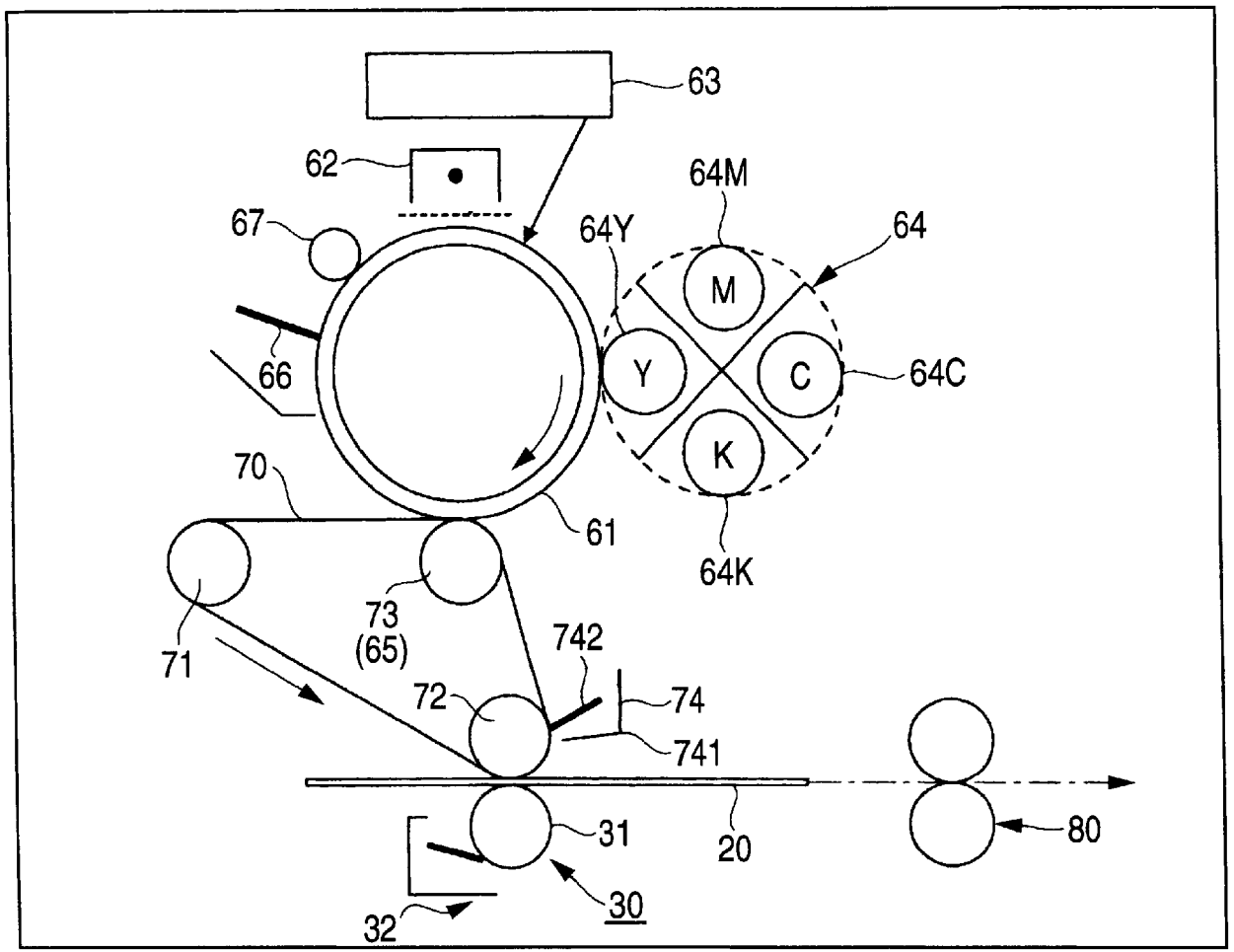

FIG. 13 is an explanatory view illustrating the entire structure of an image-forming apparatus according to the fifth embodiment.

Figure 14:
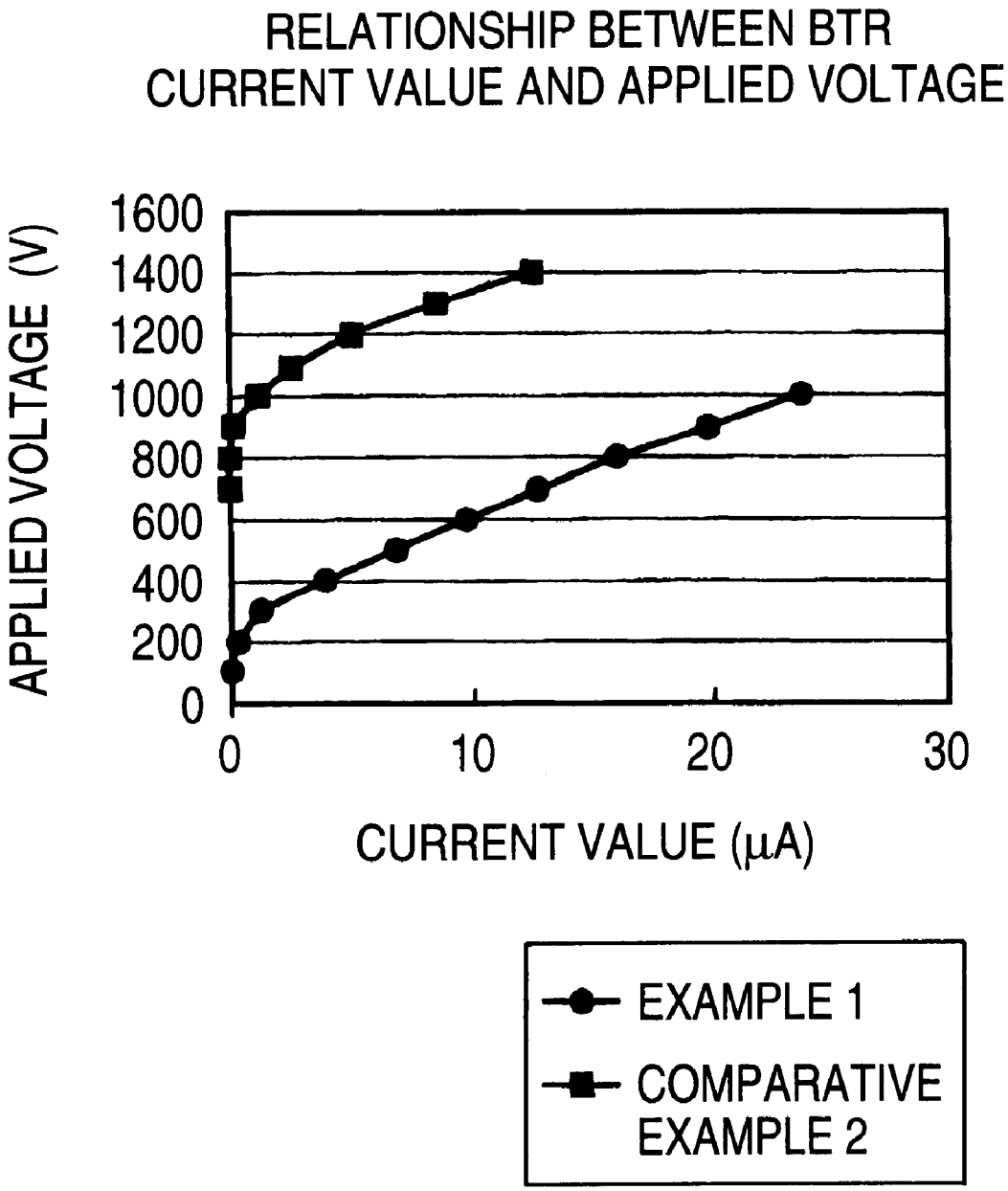

FIG. 14 is an explanatory view illustrating relationship between current and applied voltage on transfer rolls (BTR) of an Example 1 and a Comparative Example 1.

Figure 15A:
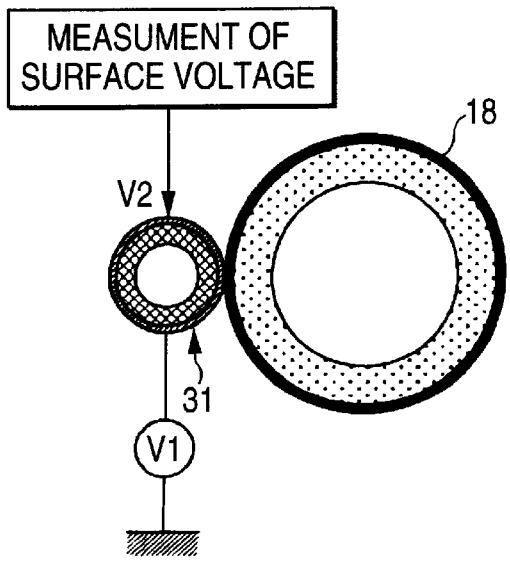

FIG. 15A is an explanatory view illustrating voltage V1 applied to transfer rolls (BTR) of the Example 1 and the Comparative Example 1, and measurement model of surface potential V2 of these transfer rolls.

Figure 15B:
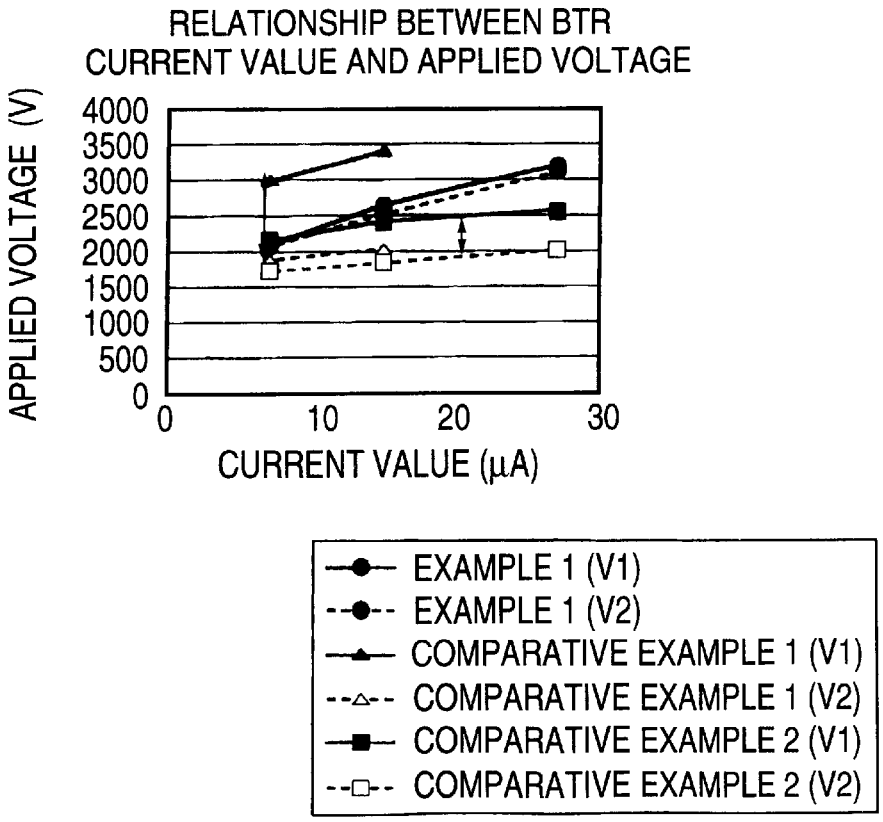

FIG. 15B is a graph illustrating plot of voltages V1 and V2 against various current values in the Example 1 and the Comparative Examples 1 and 2.

Figure 16:
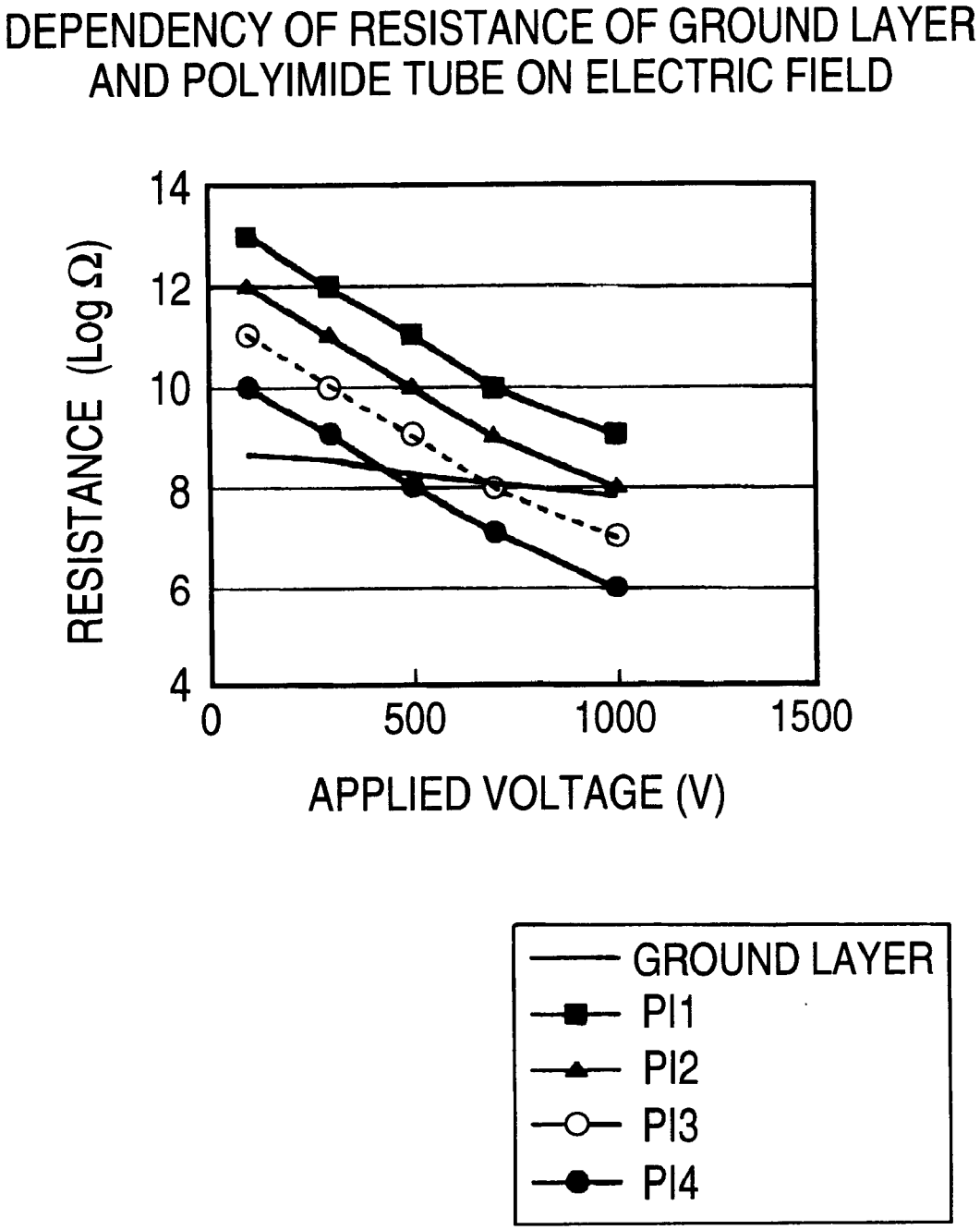

FIG. 16 is a graph illustrating results of examination of dependence of resistance of subbing layer and polyimide tube on electric field in an Example 2.

Figure 17:
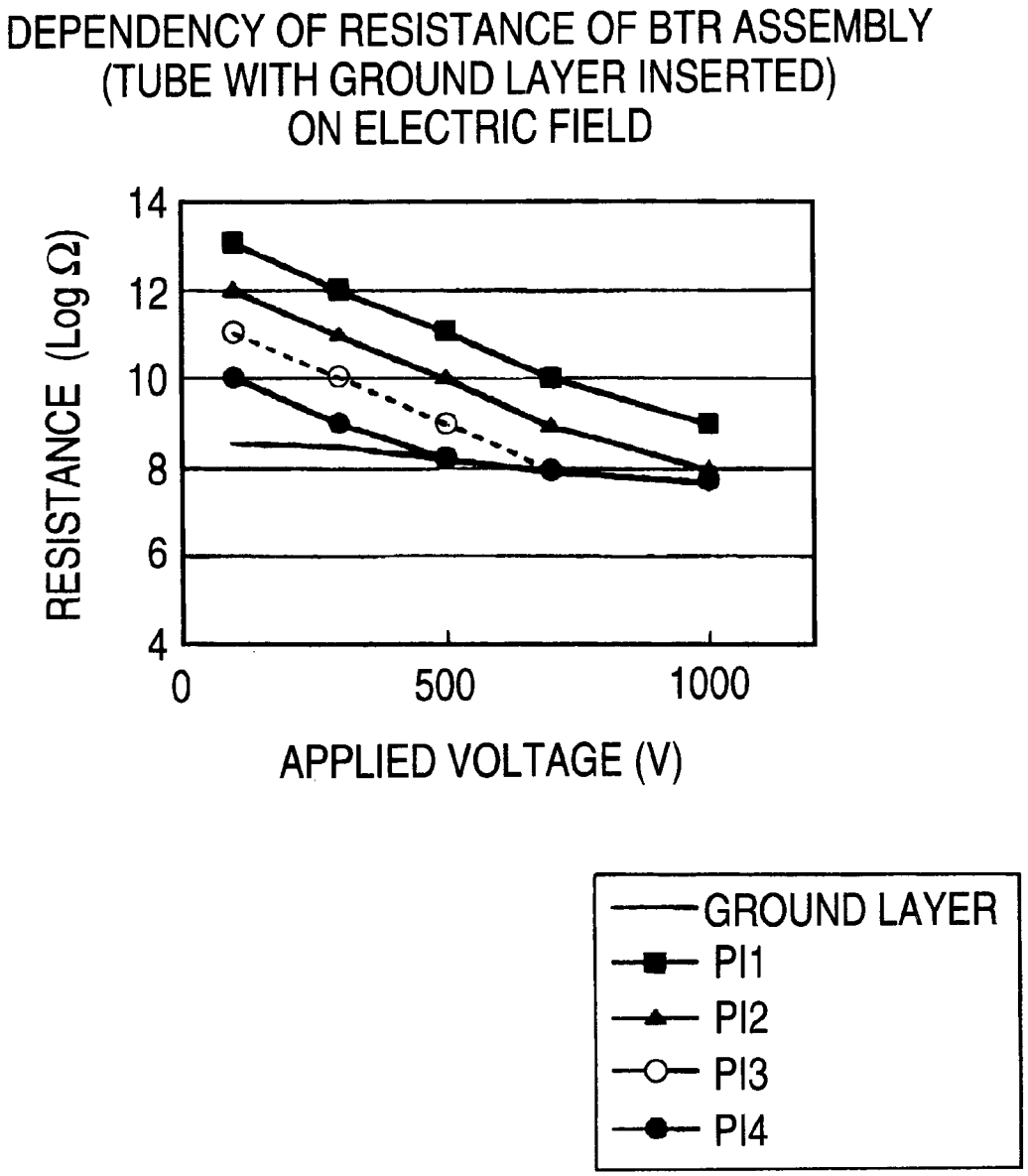

FIG. 17 is a graph illustrating results of examination of dependence of resistance of transfer roll (BTR) assembly on electric field in the Example 2.

FIG. 18 is a graph illustrating relationship between modulus of subbing layer and guard resin layer and cleaning properties in an Example 3.

DETAILED DESCRIPTION OF THE PREFERRED EMBODIMENTS

The present invention will be given based on embodiments shown in attached drawings.

(First Embodiment)

Figure 1A:
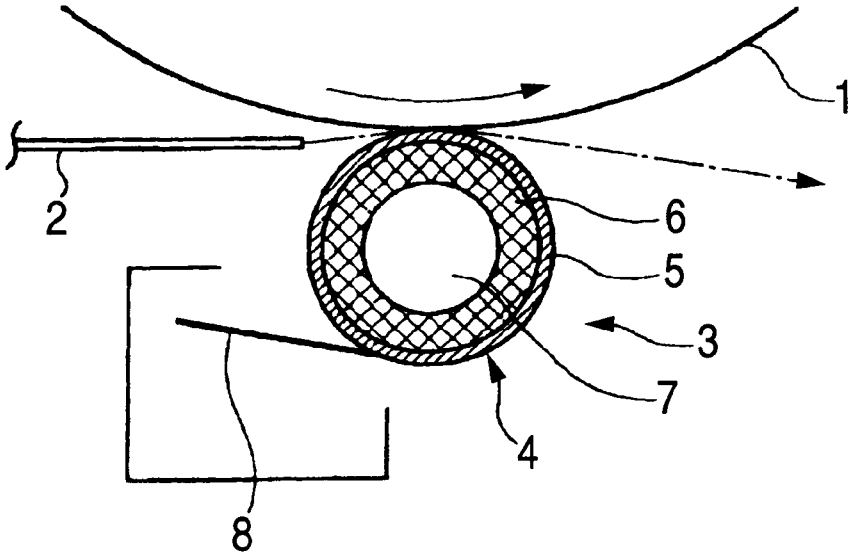
FIG. 1A is an explanatory view illustrating an outline of a transfer device according to the present invention and an image-forming apparatus using the transfer device.
Figure 1B:
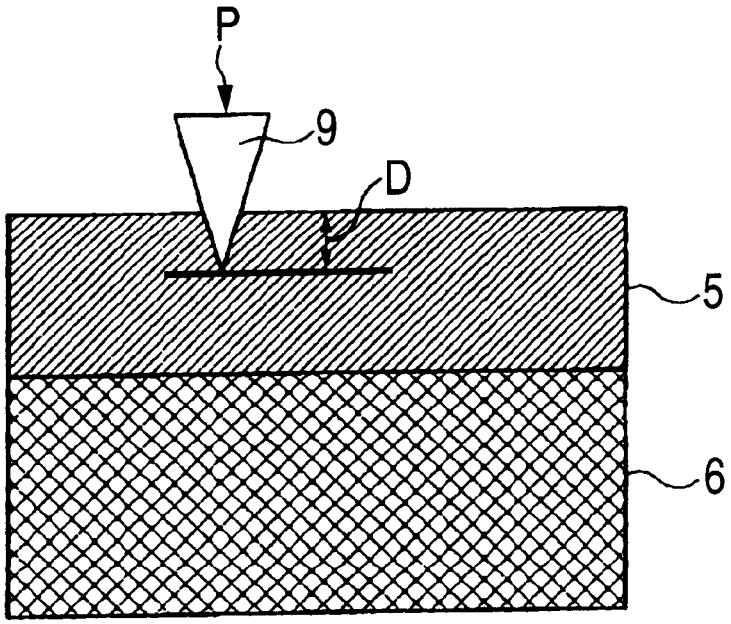
FIG. 1B is an explanatory view illustrating surface microhardness to be used in the invention.
Figure 2:
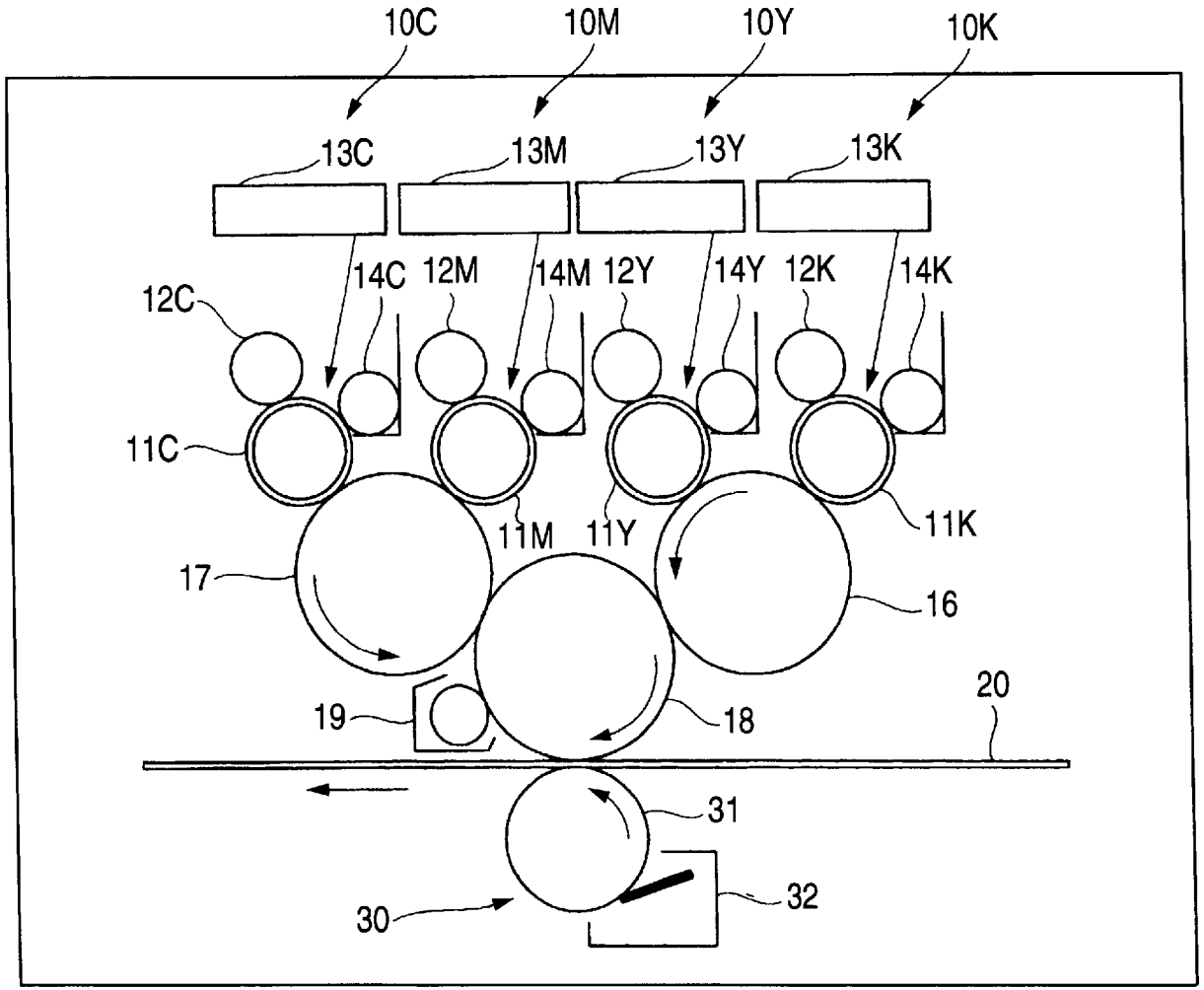
FIG. 2 is an explanatory view illustrating the entire structure of an image-forming apparatus according to the first embodiment.

FIG. 2 is an explanatory view illustrating the entire structure of an image-forming apparatus according to the first embodiment of the invention.

In FIG. 2, the image-forming apparatus is, for example, an intermediate transfer type tandem image-forming apparatus employing an electrophotographic process and comprising four image-forming units 10 (specifically, 10K, 10Y, 10M, and 10C) in which black (K), yellow (Y), magenta (M) and cyan (C) toner images are formed, respectively.

Each of image-forming units 10 (10K to 10C) comprises a photoreceptor drum 11 (11K to 11C) on which an electrostatic latent image is formed and supported. Around the the photoreceptor drum 11, electrophotographic devices are provided such as charging devices 12 (12K to 12C) for charging the photoreceptor drums 11 (charging roll in this example), exposing devices 13 (13K to 13C) such as laser scanning device for forming an electrostatic latent image corresponding to the various color components on the charged photoreceptor drum 11 and developing devices 14 (14K to 14C) for developing the electrostatic latent image formed on the photoreceptor drum 11 with a corresponding color toner.

A first intermediate transfer drum 16 is provided on the photoreceptor drums 11K and 11Y of the first and second image-forming units 10K and 10Y, respectively, so as to come in rolling contact with the photoreceptor drums 11K and 11Y. A second intermediate transfer drum 17 is provided on the photoreceptor drums 11M and 11C of the third and fourth image-forming units 10M and 10C, respectively, so as to come in rolling contact with the photoreceptor drums 11M and 11C. A third intermediate transfer drum 18 is provided on the first and second intermediate transfer drums 16 and 17 so as to come in rolling contact with the intermediate transfer drums 16, 17.

A transfer device 30 is provided on the third intermediate transfer drum 18 so as to transfer a multi-color toner image supported on the third intermediate transfer drum 18 to a recording material 20.

Incidentally, a drum cleaner 19 (brush cleaner in this example) is provided on a downstream side of the third intermediate transfer drum 18 so as to remove residual toner from a surface of the third intermediate transfer drum 18.

In this embodiment, the transfer device 30 comprises a transfer roll 31 provided to come in rolling contact with an intermediate transfer drum 18 and a roll cleaner 32 for cleaning a surface of the transfer roll 31 as shown in FIGS. 2 and 3.

As the transfer roll 31, there is used a metal roll (core) 311, e.g., made of aluminum having an adjustment resistance layer 313, e.g., made of foamed polyurethane on a surface thereof and a guard resin layer 312, e.g., made of polyimide resin formed on a surface of the adjustment resistance layer 313.

In this embodiment, the guard resin layer 312 is formed by, e.g., an electronically-conductive polyimide resin and has a measured value in a range of 18 to 50, which is measured under a test load of 2.0 gf (19.6 mN) and a loading rate of 0.0145 gf (0.1421 mN)/sec by a Type DUH-201S dynamic ultramicrohardness meter produced by Shimadzu Corp. while using a triangular pyramid indenter having a ridge angle of 115°.

Incidentally, for reference, other materials were measured for surface microhardness under the same conditions. As a result, PVDF, fluorine coat and polyurethane were found to have surface microhardness of from 5 to 10, 2 and from about 1 to 2, respectively.

A thickness t1 of the guard resin layer 312 is preferably from 10 $\mu$m to 100 $\mu$m, more preferably from 40 $\mu$m to 80 $\mu$m as shown in FIG. 4A.

The guard resin layer 312 has a contact angle of from 70° to 80° with respect to water.

The guard resin layer 312 has a Young's modulus of 200 kg/mm$^2$ at minimum and normally not smaller than 400 kg/mm$^2$.

Of course, the guard resin layer 312 has a similar value of modulus, which is analogous to Young's modulus.

A resistance R1 of the guard resin layer 312 is properly determined by adjusting the amount of the resistance regulator such as carbon black to be included as shown in FIG. 4A.

A surface roughness of the guard resin layer 312 may be not greater than the minimum particle diameter of the toner, e.g., less than 2 $\mu$m, preferably not greater than 1 $\mu$m as calculated in terms of 10-point average roughness Rz.

When the surface roughness of the guard resin layer 312 is greater than the minimum particle diameter of the toner, the toner can be caught by unevenness on the surface of the transfer roll 31, the toner sneaks through the metallic scraper 322. This problem can be effectively avoided by the foregoing arrangement.

On the other hand, the adjustment resistance layer 313 is formed by a foamed polyurethane. A resistance R2 of the adjustment resistance layer 313 is set in a range of about $10^6\Omega$ to $10^9\Omega$ when 1,000 V is applied.

In relation to resistance condition between the guard resin layer 312 and the adjustment resistance layer 313, it is necessary that at least the resistance R1 of the guard resin layer 312 is set to be lower than the resistance R2 of the adjustment resistance layer 313 as substantiated in examples described later.

A thickness t2 of the adjustment resistance layer 313 is set to be greater than that of the guard resin layer 312, normally not smaller than 1 mm.

The thickness t1 of the guard resin layer 312 is about 100 μm at maximum. Even if the resistance of the guard resin layer 312 is the same as that of the adjustment resistance layer 313 (actually smaller than that of the adjustment resistance layer 313), since when the thickness of the adjustment resistance layer 313 is 10 times that of the guard resin layer 312, time constant of the adjustment resistance layer 313 is 10 times that of the guard resin layer 312, accumulation of charge on the adjustment resistance layer 313 is effectively prevented.

Since the adjustment resistance layer 313 has an Asker C hardness of not smaller than 20 under a load of 500 gf (4.9 N), there can be secured a wide nip region between the transfer roll 31 and the intermediate transfer drum 18 without raising the nip pressure.

Method for producing the transfer roll 31 according to the present embodiment will be given hereinafter.

As shown in FIG. 5, the producing process of the transfer roll 31 according to the present embodiment comprises the steps of inserting an inner structure 102 having an adjustment resistance layer 313 formed on a metallic roll 311 into a polyimide tube 101 which acts as the guard resin layer 312 so that the outer surface of the inner structure 102 adheres closely to the inner surface of the polyimide tube 101.

An example of method for producing the polyimide tube 101 is shown in FIG. 6. An example of method for producing the inner structure 102 is shown in FIG. 7.

At first, the process for producing the polyimide tube 101 will be given. As shown in FIG. 6, carbon black (C.B.) is appropriately added to a polyimide varnish (hereinafter occasionally referred to as "PI varnish") in an agitation vessel to mix with material. Thereafter, the material is subjected to dispersion while beads being added.

Then, the material is coated to a roll mold having a predetermined outer diameter, and after being dried and baked, the roll mold is removed to produce a polyimide tube 101.

Thereafter, the polyimide tube 101 is examined for film thickness, roughness, inner diameter, resistance, and external appearance. The polyimide tube 101 which has passed through the inspection is selected.

The process for producing the inner structure 102 will be given. As shown in FIG. 7, the inner structure 102 having the adjustment resistance layer 313 attached to a metallic roll (shaft) 311 is prepared. The inner structure 101 is examined for outer diameter, deflection and resistance. The inner structure 102 is then cooled in a constant temperature-constant humidity chamber.

Accordingly, as shown in FIG. 5, the insertion of the inner structure 102 into the polyimide tube 101 is conducted smoothly because the inner structure 102 is placed at ordinary temperature shortly after cooling to make the outer diameter d1 thereof smaller than the inner diameter d2 of the polyimide tube 101.

Thereafter, the inner structure 102 undergoes thermal expansion with time. The final outer diameter d3 of the inner structure 102 is set to be smaller than the initial outer diameter d2 and slightly greater than the inner diameter d2 of the polyimide tube 101.

In this arrangement, since the adjustment resistance layer 313 of the inner structure 102 has a proper elasticity, the polyimide tube 101 is provided with a sufficient tension with respect to the inner structure 102 to dispose the polyimide tube 101 and the inner structure 102 in close contact with each other. Thus, a transfer roll 31 comprising the polyimide tube 101 as the guard resin layer 312 is completed.

The polyimide tube 101 is always provided with tension by the adjustment resistance layer 313. However, when there is a small difference in modulus (Young's modulus) between the polyimide tube 101 and the adjustment resistance layer 313, this tension causes harmful unevenness on the surface of the polyimide tube 101.

Therefore, it is preferred that the modulus (Young's modulus) of the polyimide tube 101 is three or more times that of the adjustment resistance layer 313. In this case, however, the hardness of the adjustment-resistance layer 313 is preferably not smaller than 20 in terms of Asker C hardness under a load of 500 gf (4.9 N).

In this embodiment, the roll cleaner 32 comprises a metallic scraper 322 fixed at the base end thereof to a bracket (not shown) and disposed in contact with the surface of the transfer roll 31 at the other end thereof.

The metallic scraper 322 is made of, e.g., SUS and the like. As shown in FIG. 8A, an edge face of the scraper 323 may be etched to secure sufficient scraping function.

In a case where frictional resistance of the metallic scraper 322 with the surface of the transfer roll 31 needs to be further reduced, at least an area where the metallic scraper 322 and the transfer roll 31 of the scraper 323 contact with each other may be coated with a low friction coat layer (e.g., fluorine coat layer) as shown FIG. 8B.

The thickness and free length of the metallic scraper 322 may be properly set according to desired pressure of the metallic scraper 322.

The layout of the metallic scraper 322 may be properly set. Taking into account the scraping properties, the metallic scraper 322 is preferably disposed in so-called layout from a doctor direction, that is, the metallic scraper 322 is disposed so that a forward end of the metallic scraper 322 turns to a direction opposite to a rotational direction of the transfer roll 31. A set angle of the metallic scraper 322 with respect to the tangent line of the transfer roll is preferably in a range of about 15° to 45°.

The metallic scraper 322 is supported to be insulated from the ground so that the transferring current does not leak from the metallic scraper 322.

In this embodiment, as shown in FIGS. 3 and 9, in view of preventing the metallic scraper 322 from being caught by the transfer roll 31, the metallic scraper 322 is formed to be curved at an end 322*a* in a lengthening direction, which contacts with the transfer roll 31.

There is an apprehension that when the metallic scraper 322 is caught by the transfer roll 31, the metallic scraper 322 is destroyed or the transfer roll 31 is damaged to cause defective cleaning or defects in transferred image. The foregoing arrangement makes it possible to effectively eliminate this apprehension.

In this embodiment, as shown in FIG. 3, a process for controlling the image density by reading an image to be detected in density (e.g., density patch) which has been transferred onto the transfer roll 31 to stabilize the image density is employed.

Specifically, an optical density sensor 41 is provided at a position opposed to the transfer roll 31 as shown in FIG. 3. The output of the density sensor 41 is inputted to a process controller 40.

The process controller 40 forms density patch of each color on the photoreceptor drum 11 of the image-forming units 10 of each color component, transfers the density patches to the transfer rolls 31 via the first to third intermediate transfer drums 16 to 18, respectively, detects the density patch of each color by the density sensor 41, and then performs density control of each image-forming unit 10 on a basis of the density information.

In this embodiment, a spherical toner (polymer toner in this embodiment) having a shape coefficient ($ML^2/A$) of not greater than 130 is used to provide the toner image with a high transferability.

In order to secure desired cleaning properties and transferability, the spherical toner comprises proper external additives incorporated therein.

The shape coefficient ($ML^2/A$) of toner is represented by the following equation:

$$\text{shape coefficient } (ML^2/A) = \frac{(\text{absolute maximum length of toner diameter})^2}{\text{Projected area of toner}} \times \frac{\pi}{4} \times 100 \quad \text{(Eq. 1)}$$

An operation of the image-forming apparatus according to this embodiment will be given.

In this embodiment, an imaging process comprises a steps of: forming toner image of each color on the photoreceptor drums 11 (11K to 11C) of the image-forming units 10 of each color (10K to 10C); transferring the toner images on the photoreceptor drums 11K and 11Y of the first and second image-forming units 10K and 10Y to the first intermediate transfer drum 16, respectively, and the toner images on the photoreceptor drums 11M and 11C of the third and fourth image-forming units 10M and 10C to the intermediate transfer drum 17, respectively; transferring the toner image of each color on the first and second intermediate transfer drums 16 and 17 to the third intermediate transfer drum 18; and then transferring the toner image of each color on the third intermediate transfer drum 18 to a recording material 20 at once by the transfer device 30.

The residual toner on the third intermediate transfer drum 18 is removed by the drum cleaner 19.

In such imaging process, focusing on the transfer device 30, since the surface of the transfer roll 31 is formed by the guard resin layer 312 made of the polyimide resin, the surface friction of the guard resin layer 312 with the metallic scraper 322 is kept low.

Since the frictional resistance between the guard resin layer 312 and the metallic scraper 322 can be kept low, torque of the transfer roll 31 can be reduced. Furthermore, vibration of the metallic scraper 322 during rotational driving of the transfer roll 31 can be kept low. Therefore, the cleaning properties of the metallic scraper 322 can be kept stable.

Moreover, since the surface of the transfer roll 31 is the guard resin layer 312 made of the polyimide resin, surface reflectance of the transfer roll 31 is very high to enable to raise SN ratio of reflected light from the toner image such as the density patch to reflected light from a toner-free area.

On this account, when the density patch is formed on the surface of the transfer roll 31 to perform image density control, which is one of process controls, the density information of the density patch can be accurately detected.

Furthermore, it was also confirmed that the density patch, the residual toner, and the like formed on the transfer roll 31 is certainly removed by the metallic scraper 322.

In this embodiment, the transfer roll 31 comprises the adjustment resistance layer 313 as a ground layer for the guard resin layer 312. Therefore, even when transfer is conducted in a high electric field as in PHP sheet or cardboard or as in double-sided printing, charge is not accumulated on the guard resin layer 312, and stable transfer electric field is always obtained.

In an embodiment comprising a single guard resin layer 312 provided on the metallic roll 311 such as a comparative model 1 shown in FIG. 4B, charge is accumulated on the guard resin layer 312. On the other hand, in an embodiment comprising two guard resin layers 312 (1) and 312 (2) provided on the metallic roll 311 such as a comparative model 2 shown in FIG. 4C, a phenomenon of charge accumulation on the guard resin layers 312 (1) and 312 (2) occurs, too, similarly to the comparative model 1 shown in FIG. 4B when resultant resistance thereof is considerably high.

This embodiment was subjected to print test over 30,000 sheets of each of 30 various recording materials in an atmosphere ranging from high temperature/high humidity to low temperature/low humidity. As a result, this embodiment was found to be able to keep the cleaning properties of the metallic scraper 322 good and keep a high image quality.

In this respect, the comparative models 1 and 2 were subjected to print test in the same manner as mentioned above. As a result, these comparative models did not perform defective cleaning by the metallic scraper 322 even throughout 30,000 sheets but occasionally could not provide a sufficient transfer electric field during printing on OHP sheet or cardboard or during double-sided printing. There was some cases not to obtain a good image quality.

The foregoing evaluation of performance is substantiated by the examples described later.

(Second Embodiment)

FIG. 10 is an explanatory view of an essential part of a second embodiment of an image-forming apparatus to which the present invention is applied.

In FIG. 10, basic constitution of the image-forming apparatus is almost the same as that of the first embodiment, but constitution of the transfer device 30 is different from that of the first embodiment. Where the constituent elements are the same as those of the first embodiment, like numerals are used and further description are omitted.

In this embodiment, unlike that of the first embodiment, the transfer roll 31 of the transfer device 30 comprises an adjustment resistance layer 315 made of, e.g., polyurethane formed on a roll (core) 311 made of a metal such as aluminum and a guard resin layer 314 made of an epoxy resin having a high surface abrasion resistance formed on the adjustment resistance layer 315.

In this embodiment, the guard resin layer 314 is prepared by applying an epoxy resin to a roll body having the adjustment resistance layer 315 provided thereon. During this procedure, thickness of the coat layer of the epoxy resin is properly adjusted in a range of 1 $\mu$m to 20 $\mu$m.

The roll cleaner 32 comprises a metallic scraper 322 made of SUS as in the first embodiment. Thickness of the metallic scraper 322 is preferably not greater than 200 $\mu$m.

In this embodiment, carbon or an ionically-conducting agent is added to the epoxy resin constituting the guard resin layer 314 to be electrically-conductive so that the resistance of the guard resin layer 314 is properly adjusted to not greater than $10^{10}\Omega$. As a result of the above described, the guard resin layer 314 provided with electrical conductivity is prevented from being strongly charged to enable to maintain the desired cleaning properties of the metallic scraper 322 over an extended period of time.

Incidentally, for example, a simplicial epoxy resin has about $10^{13}\Omega$ in a resistance. When a transfer electric field (plus bias) is applied, the guard resin layer 314 made of the simplicial epoxy resin is strongly charged positively to have a strong attraction for the negatively charged toner. Under these conditions, there is an apprehensiveness that cleaning cannot be conducted in an attempt to scrape the toner by the metallic scraper 322.

In this embodiment, the adjustment resistance layer 315 is formed of a material having a lower resistance than that of the guard resin layer 314 so that charge easily escapes from the guard resin layer 314.

On this account, abnormal charging of the guard resin layer 314 is prevented, and the attachment of the toner to the guard resin layer 314 is prevented.

The adjustment resistance layer 315 is set to have an Asker C hardness of not smaller than 70 under a load of 500 gf (4.9 N).

On this account, bite of the metallic scraper 322 due to an indentation of the transfer roll 31 can be reduced.

When the Asker C hardness of the adjustment resistance layer 70 falls below 70, the transfer roll 31 can be easily indented locally on the surface thereof when brought into contact with the metallic scraper 322. If the indention is on the surface of the metallic role 31, the metallic scraper 322 would be caught by the indentation. When the metallic scraper 322 is caught, there is an apprehensiveness of destruction of the transfer roll 31, destruction of the metallic scraper 322, or the like.

In this embodiment, these defects can be effectively avoided.

In this embodiment, the metallic scraper 322 may have the same constitution as that of the first embodiment. Furthermore, in order to reduce the friction of the metallic scraper 322 with the guard resin layer 314 of the transfer roll 31 so that smoother rotation can be conducted, the epoxy resin constituting the guard resin layer 314 may be added a fluororesin such as PTFE.

(Third Embodiment)

FIG. 11A is an explanatory view illustrating an essential part of a third embodiment of the image-forming apparatus to which the present invention is applied.

In FIG. 11A, unlike the first and second embodiments, the transfer device 30 comprises a transfer belt 33 instead of the transfer roll 31.

The transfer belt 33 shown in FIG. 11A comprises a belt member 333 having a guard resin layer 333*a* made of, e.g., polyimide formed at least on a surface thereof and an adjustment resistance layer 333*b* formed as a ground layer, the belt member is put up between support rolls 331 and 332. A bias roll 334 for applying a transfer bias is disposed opposed to the intermediate transfer drum 18 with the belt member 333 interposed therebetween.

A belt cleaner 34 (having a metallic scraper 342) is disposed opposed to the support roll 332 of the transfer belt 33. The metallic scraper 342 is disposed in contact with the surface of the transfer belt 33 to clean the surface of the transfer belt 33.

A modification of this embodiment is shown in FIG. 11B.

A transfer belt 35 shown in FIG. 11B comprises a belt member 354 having a guard resin layer 354*a* made of, e.g., polyimide formed at least on a surface thereof and an adjustment resistance layer 354*b* formed as a ground layer, the belt member 354 is put up over support rolls 351 to 353. One of these support rolls (roll 352 in this embodiment) is disposed opposed to the intermediate transfer drum 18 to act also as a bias roll for applying a transfer bias. A reference numeral 36 is a belt cleaner (having a metallic scraper 362) for cleaning the belt member 354.

In these embodiments, the belt members 333 and 354 of the transfer belts 33 and 35 comprise the guard resin layers 333*a* and 354*a* and the adjustment resistance layers 333*b* and 354*b*, respectively. Therefore, these transfer belts have almost the same function and effect as that of the transfer roll 31 of the first and second embodiments.

(Fourth Embodiment)

FIG. 12 is an explanatory view illustrating the entire structure of a fourth embodiment of the image-forming apparatus to which the present invention is applied.

In FIG. 12, the image-forming apparatus is an intermediate transfer type tandem image-forming apparatus employing electrophotography similarly to the first to third embodiments. Unlike the first embodiment, this image-forming apparatus comprises an intermediate transfer belt 50 disposed opposed to the photoreceptor drum 11 (11K to 11C) of the image-forming units 10 (10K to 10C), respectively, and the color toner images transferred onto the intermediate transfer belt 50 are transferred at once to the recording material 20 by the transfer device 30. Where the constituent elements are the same as those of the first embodiment, like numerals are used and further description are omitted.

The intermediate transfer belt 50 is put up over four support rolls 51 to 54 and is circulated together with the photoreceptor drum 11 of each color. Primary transfer devices (primary transfer rolls in this embodiment) 15 (15K to 15C) are disposed on back side of the intermediate transfer belt 50 opposed to the photoreceptor drums 11 (11K to 11C), respectively, so that the toner image of each color on the photoreceptor drum 11 is transferred to and retained by the intermediate transfer belt 50. In this embodiment, the primary transfer rolls 15K and 15C also acts as support rolls 51 and 52, respectively.

The transfer device 30 is disposed to be opposed to the support roll 53. A belt cleaner (brush cleaner in this embodiment) 57 is disposed to be opposed to the support roll 54 on the back side of the intermediate transfer belt 50.

Accordingly, in this embodiment, each color toner image formed on the each image-forming unit 10 (10K to 10C) is primarily transferred to the intermediate transfer belt 50, and then transferred at once (secondarily) to the recording material via the transfer device 30.

In the foregoing imaging process, the transfer device 30 operates in almost the same manner as in the first to third embodiments.

(Fifth Embodiment)

FIG. 13 is a diagram illustrating the entire structure of a fifth embodiment of the image-forming apparatus according to the invention.

In FIG. 13, unlike the image-forming apparatus of the first to fourth embodiments, the image-forming apparatus of this embodiment is a four cycle type image-forming apparatus employing electrophotography. This image-forming apparatus comprises, around a photoreceptor drum 61, a charger 62 such as scorotoron, an exposing device 63 for writing an electrostatic latent image such as laser scanning device, a rotary developing device 64 which can be rotated to switch selectively a developing units 64K to 64C contains color toners (black (K), yellow (Y), magenta (M), cyan (C)) respectively, an intermediate transfer belt 70, a drum cleaner (a blade cleaner in this embodiment) and a destaticizer 67 such as destaticizing roll. A primary transfer device (a primary transfer belt in this embodiment) is disposed to be opposed to the photoreceptor drum 61 on back side of the intermediate transfer belt 70. A transfer device 30 similar to that of the first and second embodiments is disposed at a predetermined position opposed to the intermediate transfer belt 70. Color toner images transferred to the intermediate transfer belt 70, respectively, are transferred to the recording material 20 at once. A reference numeral 80 indicates a fixing device for allowing the recording material 20 to pass therethrough and fixing the transferred toner image.

In this embodiment, the intermediate transfer belt 70 is put up over three support rolls 71 to 73. One of the support rolls (the roll 73 in this embodiment) also acts as the foregoing primary transfer roll 65.

The transfer device 30 is disposed to be opposed to the support roll 72 and upstream of the support roll 72. A belt cleaner 74 is disposed downstream of the support roll 72.

In this embodiment, the intermediate transfer belt 70 is made of a polyimide resin. The belt cleaner 74 comprises a metallic scraper 742 fixed at its base end with a bracket (not shown) and disposed to contact with the surface of the intermediate transfer belt 70 at the other end thereof.

Accordingly, in this embodiment, the imaging process comprises the steps of: forming a color toner image on the photoreceptor drum 61 every color cycle; primarily transferring each of color toners to the intermediate transfer belt 70 in succession; and then transferring the multi-color transferred toner image onto the intermediate transfer belt 70 at once (secondarily) to a recording material 20 via the transfer device 30.

In this embodiment, the transfer device 30 has the same function as the first and second embodiments. Referring to the relationship between the intermediate transfer belt 70 and the belt cleaner 74, the intermediate transfer belt 70 is formed of a polyimide resin to enable to suppress surface friction of the polyimide resin with the metallic scraper 742.

Further, since the frictional resistance between the intermediate transfer belt 70 and the metallic scraper 742 can be suppressed, torque of the intermediate transfer belt 70 can be reduced, and vibration of the metallic scraper 742 during rotational driving of the intermediate transfer belt 70 can be reduced. On this account, cleaning properties of the metallic scraper 742 can be kept stable.

Moreover, since the surface of the intermediate transfer belt 70 is made of a polyimide resin, the surface reflectance of the intermediate transfer belt 70 is very high to enable to raise SN ratio of reflection light from toner image such as density patch to reflection light from toner-free area.

On this account, when the density patch is formed on the surface of the intermediate transfer belt 70 to perform image density control as one of process controls, the density information of the density patch can be accurately detected.

It is further confirmed that the density patch formed on the intermediate transfer belt 70 and residual toner can be certainly removed by the metallic scraper 742.

EXAMPLE 1

In the image-forming apparatus according to the first embodiment shown in FIGS. 2 and 3, relationship between transfer rolls (BTR) current and applied voltage is examined by using the transfer roll 31 of the transfer device (comprising the adjustment resistance layer 313 made of a foamed polyurethane provided on a metallic roll made of aluminum as a ground layer and the guard resin layer 312 made of a polyimide resin provided on the surface thereof).

As a Comparative Example 1, the comparative model (thin layer guard resin layer type) shown in FIG. 4B is used.

In general, a transfer electric field is applied to the transfer roll 31. The transfer roll is normally controlled with a constant current so that a constant electric field is formed over each of environments, each of recording materials and each of sizes.

Under these conditions, current-voltage curve is drawn in accordance with the resistance of the transfer roll 31 as shown in FIG. 14.

Specifically, transfer current begins to flow even at a relatively low voltage in the Example 1 while no transfer current flows even at a voltage being greater than 1 KV in the Comparative Example 1.

Theoretically speaking, if the resistance of the transfer roll 31 is determined, the phenomenon is supposed to follow Ohm's raw. However, Comparative Example 1 has large time constant $\tau$ and thus takes much time to accumulate charge.

In other words, since the time constant $\tau$ is represented by the following equation, the thickness is the smaller, the time constant $\tau$ is the greater even if the resistance remains the same.

$$\tau = \in \cdot \rho = \in \cdot R \cdot S/d$$

where $R = \rho \cdot d/SR$ $\in$: dielectric constant;

$\rho$: electrical resistance;

d: thickness;

S: area (nip width)

Supposing that, in the Example 1, the thickness of the guard resin layer 312 is 40 $\mu$m and the thickness of the adjustment resistance layer 313 is 4 mm, the time constant $\tau$ of Comparative Example 1 is 100 times that of Example 1.

As a result, Comparative Example 1 takes much time to accumulate charge and thus cannot obtain a necessary electric field.

As shown in FIG. 15A, Example 1 and Comparative Examples 1 and 2 (both these comparative examples are comparative models 1 of FIG. 4B having different polyimide resin layer thicknesses) is examined for voltage V1 applied to the transfer roll 31 and surface potential V2 of the transfer roll 31. The results are shown in FIG. 15B.

Comparative Examples 1 and 2 show a big difference between the voltage V1 applied to the transfer roll 31 and the surface potential V2 of the transfer roll 31. Thus, the applied voltage V1 needs to be raised to obtain an effective transfer electric field (V2). Accordingly, Comparative Examples 1 and 2 are subject to easy accumulation of charge on the transfer roll 31 and thus cannot be provided with desired transfer electric field.

In Examples 1 and 2, it takes a long time to decay the charge when the transfer bias is cut off so that phenomenon such as injection of the charge into the intermediate transfer drum 18 and the like occurs and the phenomenon has bad influences.

On the contrary, in the present example, due to an action of the adjustment resistance layer 313 of the transfer roll 31, the charge to be accumulated on the guard resin layer 312 flows out toward the adjustment resistance layer 313 to prevent the accumulation of the charge on the guard resin layer 312. Further, even when transfer bias is cut off, the charge can be rapidly decayed on the adjustment resistance layer 313 side to enable to keep the transferring properties of the transfer roll 31 good.

EXAMPLE 2

In this example, the relationship in resistance between a polyimide tube which acts as a guard resin layer and a ground layer (adjustment resistance layer) is examined.

In this example, a transfer roll according to the first embodiment is used. The ground layer is made of a foamed polyurethane. The ground layer is added an electronically-conducting material (carbon black) to have electrical conductivity. Therefore, the ground layer has little dependence of resistance on electric field as shown in FIG. 16.

On the other hand, the polyimide tube comprises carbon black dispersed therein. Thus, the polyimide tube has dependence of resistance on electric field in general as shown in FIG. 16.

Polyimide tubes (PI1 to PI4) having four different resistance levels are prepared as shown in FIG. 16. The ground layer is then inserted into these polyimide tubes to prepare transfer rolls (BTR assemblies). The resistance of these transfer rolls show higher resistance out of that of the polyimide tube and that of the ground layer, as shown in FIG. 17.

A voltage in a range of 500 v to 1,000 V is actually required to transfer. In this range of voltage, the transfer roll has a resistance of from $10^6\Omega$ to $10^9\Omega$.

Accordingly, it is necessary that the resistance of the polyimide tube is lower than that of the ground layer in this range of voltage.

When the resistance of the polyimide tube is not lower than that of the ground layer, charge is accumulated on the polyimide tube so as not to apply necessary electric field as necessary and hence there is caused imperfect transfer that has bad influence on image quality, particularly when a high electric field is applied (i.e., when the resistance of paper is high as OHP sheet, cardboard or during double-sided printing), the bad influence is caused remarkably.

EXAMPLE 3

In this example, the relationship in modulus between a polyimide tube which acts as a guard resin layer and a ground layer (an adjustment resistance layer) is examined.

In this example, a transfer roll according to the first embodiment is used. The modulus between the guard resin layer (PI layer) and the adjustment resistance layer is varied, and then surface roughness and cleanability of the transfer roll (BRT) is examined. The results are shown in FIG. 18.

In FIG. 18, when the modulus of the adjustment resistance layer is not smaller than that of the guard resin layer (PI layer), the unevenness of the ground layer appears on the surface of the polyimide tube. This unevenness exerts an adverse effect on the cleanability. Substitute for unevenness is defined by surface roughness Rz.

As shown in FIG. 18, when Rz is not smaller than 2.0, the cleanability of the transfer roll is adversely affected. When Rz is smaller than 1.0, no problems occur. It is thus understood that when the modulus of the adjustment resistance layer is smaller than that of the guard resin layer (PI layer), the cleanability of the transfer roll is kept good.

The actual ground layer is made of a foamed polyurethane and thus has a modulus of not greater than 50 kg/mm$^2$. A solid ground layer has a modulus of 200 kg/mm$^2$ at maximum.

As mentioned above, according to the present invention, a transfer device comprises a transferring member for nipping and conveying a recording material between the transferring member and an image carrier wherein a predetermined guard resin layer is provided on a surface of the transferring member and an adjustment resistance layer is provided as a ground layer of the guard resin layer for preventing the accumulation of charge on the guard resin layer, thereby exerting the following technical effects.

In other words, a metallic scraper having a low frictional resistance can be disposed as a cleaning blade in contact with a surface of a guard resin layer having an excellent abrasion resistance to enable to easily clean the surface of the transferring member at a low torque without damaging the transferring member.

Further, the surface of the transferring member is constituted by a polyimide resin or epoxy resin, thereby enabling to render the surface layer of the transferring member smooth and highly reflective. Thus, even if a process is employed which comprises the step of forming a process control image such as density patch for density control on the surface of the transferring member, the process control image can be accurately detected. Moreover, the use of the cleaning member such as the metallic scraper makes it possible that the process control image detected can be removed certainly.

In accordance with the invention, an adjustment resistance layer is provided as a ground layer of the guard resin layer to prevent the accumulation of charge on the guard resin layer to enable to effectively prevent the accumulation of charge on the surface of the transferring member.

Accordingly, a sufficient transfer electric field can be obtained even under transfer conditions requiring high electric field as in printing on OHP sheet or cardboard or in double-sided printing to enable to keep the transfer properties invariably good.

The image-forming apparatus according to the invention can be cleaned at a low torque while keeping the transfer properties good. Further, when the process is employed which comprises the step of forming the process control image such as the density patch for density control on the surface of the transferring member, the transfer device which can certainly accomplish the detection of the process image is used, therefore an extremely good transfer process can be easily realized.

What is claimed is:

1. A transfer device for transferring an image on an image carrier to a recording material, the transfer device comprising:

a transferring member adapted to nip and convey the recording material between the transferring member and the image carrier;

a guard resin layer having a surface microhardness of not smaller than 18 as measured under a test load of 2.0 gf (19.6 mN) and a load rate of 0.0145 gf (0.1421 mN)/sec by a Type DUH-201S dynamic ultramicrohardness meter produced by Shimadzu Corp. with a triangular pyramid indenter having 115° in a ridge angle, the guard resin layer provided on a surface of the transferring member; and an adjustment resistance layer provided as a ground layer of the guard resin layer, the adjustment resistance layer adapted to inhibit an accumulation of charge in the guard resin layer.

2. The transfer device according to claim 1, wherein the surface microhardness of the guard resin layer is not smaller than a surface microhardness corresponding to a polyimide resin.

3. The transfer device according to claim 1, wherein the guard resin layer has a contact angle of not smaller than 70° with respect to water.

4. The transfer device according to claim 1, wherein the guard resin layer has a thickness in a range of 10 μm to 100 μm.

5. The transfer device according to claim 1, wherein the guard resin layer has a Young's modulus of not smaller than 200 kg/mm$^2$.

6. The transfer device according to claim 1, wherein said guard resin layer is formed of a polyimide resin.

7. The transfer device according to claim 1, wherein the adjustment resistance layer has elasticity so that a nip region having a predetermined width is formed between the transferring member and the image carrier.

8. The transfer device according to claim 1, wherein said adjustment resistance layer has an Asker C hardness of not smaller than 20.

9. The transfer device according to claim 1, wherein the adjustment resistance layer has a resistance in a range of $10^6\Omega$ to $10^9\Omega$ when 1,000 V is applied thereto; and resistance of the guard resin layer is lower than that of the adjustment resistance layer.

10. The transfer device according to claim 1, wherein modulus of the guard resin layer is greater than that of the adjustment resistance layer.

11. The transfer device according to claim 1, wherein the transferring member comprises a tubular guard resin layer.

12. A method for producing the transferring member of the transfer device according to claim 11, the method comprising the steps of:

preparing an inner structure having the adjustment resistance layer provided on a periphery of a base member; and inserting the inner structure into a tube serving as the guard resin layer.

13. The method according to claim 12, wherein the tube serving as the guard resin layer closely adheres to a periphery of the inner structure.

14. The method according to claim 12, further comprising the steps of:

cooling the inner structure to a low temperature before inserting the inner structure into the tube serving as the guard resin layer.

15. The method according to claim 14, wherein the inner structure has the adjustment resistance layer having a linear expansion coefficient so that an outer diameter of the inner structure at a time when the inner structure is cooled is smaller than an inner diameter of the tube serving as the guard resin layer at normal temperature and the outer diameter of the inner structure at normal temperature is greater than the inner diameter of the tube at normal temperature.

16. A transfer device for transferring an image on an image carrier to a recording material, comprising:

a transferring member adapted to nip and convey the recording material between the transferring member and the image carrier;

a guard resin layer made of an epoxy resin, provided on a surface of the transferring member; and an adjustment resistance layer provided as a ground layer of the guard resin layer, the adjustment resistance layer having a smooth interface with the guard resin layer, the adjustment resistance layer adapted to inhibit accumulation of charge in the guard resin layer.

17. The transfer device according to claim 16, wherein the guard resin layer made of the epoxy resin includes a fluororesin.

18. The transfer device according to claim 16, wherein the adjustment resistance layer has an Asker C hardness of not smaller than 70.

19. The transfer device according to claim 16, wherein the adjustment resistance layer is formed of a material having a lower resistance than that of the guard resin layer made of the epoxy resin.

20. The transfer device according to claim 1, wherein the guard resin layer has an electrically-conductive material dispersed therein.

21. The transfer device according to claim 16, wherein the guard resin layer has an electrically-conductive material dispersed therein.

22. The transfer device according to claim 1, wherein surface roughness of the transferring member is not greater than minimum diameter of image-forming particles.

23. The transfer device according to claim 16, wherein surface roughness of the transferring member is not greater than minimum diameter of image-forming particles.

24. The transfer device according to claim 1, further comprising a cleaning scraper provided to contact with the guard resin layer on the transferring member.

25. The transfer device according to claim 16, further comprising a cleaning scraper provided to contact with the guard resin layer on the transferring member.

26. The transfer device according to claim 24, wherein the scraper is made of a metal.

27. The transfer device according to claim 25, wherein the scraper is made of a metal.

28. The transfer device according to claim 26, wherein the metallic scraper is prepared by etching.

29. The transfer device according to claim 27, wherein the metallic scraper is prepared by etching.

30. The transfer device according to claim 26, wherein the metallic scraper is coated with a low friction coat layer at least on a surface thereof to contact with the transferring member.

31. The transfer device according to claim 27, wherein the metallic scraper is coated with a low friction coat layer at least on a surface thereof to contact with the transferring member.

32. The transfer device according to claim 26, wherein an end in a longitudinal direction of the metallic scraper is formed to curve, the end contacts with the transferring member.

33. The transfer device according to claim 27, wherein an end in a longitudinal direction of the metallic scraper is formed to curve, the end contacts with the transferring member.

34. The transfer device according to claim 26, wherein the metallic scraper is supported so as not to connect to the ground.

35. The transfer device according to claim 27, wherein the metallic scraper is supported so as not to connect to the ground.

36. An image-forming apparatus comprising:

an image carrier adapted to carry an image; and a transfer device adapted to transfer the image on the image carrier to a recording material, wherein the transfer device comprises:

a transferring member adapted to nip and convey the recording material between the transferring member and the image carrier;

a guard resin layer having a surface microhardness of not smaller than 18 as measured under a test load of 2.0 gf (19.6 mN) and a load rate of 0.0145 gf (0.1421 mN)/sec by a Type DUH-201S dynamic ultramicrohardness meter produced by Shimadzu Corp. with a triangular pyramid indenter having 115° in a ridge angle, the guard resin layer provided on a surface of the transferring member; and an adjustment resistance layer provided as a ground layer of the guard resin layer, the adjustment resistance layer adapted to inhibit an accumulation of charge in the guard resin layer.

37. An image-forming apparatus comprising:

an image carrier adapted to carry an image; and a transfer device adapted to transfer the image on the image carrier to a recording material, wherein the transfer device comprises:

a transferring member adapted to nip and convey the recording material between the transferring member and the image carrier;

a guard resin layer made of an epoxy resin, provided on a surface of the transferring member; and an adjustment resistance layer provided as a ground layer of the guard resin layer, the adjustment resistance layer having a smooth interface with the guard resin layer, the adjustment resistance layer adapted to inhibit accumulation of charge in the guard resin layer.

38. The image-forming apparatus according to claim 36, further comprising a process controlling unit adapted to control the image to be formed by forming a process control image on the transferring member and detecting information of the process control image.

39. The image-forming apparatus according to claim 37, further comprising a process controlling unit adapted to control the image to be formed by forming a process control image on the transferring member and detecting information of the process control image.

40. The image-forming apparatus according to claim 36, wherein image-forming particles formed on the image carrier are spherical particles having a shape coefficient of not greater than 130.

41. The image-forming apparatus according to claim 37, wherein image-forming particles formed on the image carrier are spherical particles having a shape coefficient of not greater than 130.

* * * * *